US009469974B2

(12) United States Patent
Guimaraes et al.

(10) Patent No.: US 9,469,974 B2
(45) Date of Patent: Oct. 18, 2016

(54) EXCAVATOR WEAR ASSEMBLY

(75) Inventors: Miguel Guimaraes, Mackay (AU); Bruce Lilley, Mackay (AU); Quintin Nienaber, Mackay (AU); Tony Young, Mackay (AU)

(73) Assignee: CQMS PTY LTD (AU)

( * ) Notice: Subject to any disclaimer, the term of this patent is extended or adjusted under 35 U.S.C. 154(b) by 298 days.

(21) Appl. No.: 13/497,892

(22) PCT Filed: Dec. 13, 2010

(86) PCT No.: PCT/AU2010/001682

§ 371 (c)(1),
(2), (4) Date: Jun. 28, 2012

(87) PCT Pub. No.: WO2011/069215

PCT Pub. Date: Jun. 16, 2011

(65) Prior Publication Data

US 2012/0260540 A1 Oct. 18, 2012

(30) Foreign Application Priority Data

Dec. 11, 2009 (AU) ..... 2009906064

(51) Int. Cl.
*E02F 9/28* (2006.01)

(52) U.S. Cl.
CPC ..... *E02F 9/2825* (2013.01); *E02F 9/2833* (2013.01)

(58) Field of Classification Search
CPC ... E02F 9/2808; E02F 9/2825; E02F 9/2858; E02F 9/2883; E02F 9/2816; E02F 9/2833
USPC ..... 37/452, 453, 454, 455, 456, 457, 458
See application file for complete search history.

(56) References Cited

U.S. PATENT DOCUMENTS

| | | | | |
|---|---|---|---|---|
| 3,606,471 | A * | 9/1971 | Evans | 299/112 R |
| 3,774,324 | A | 11/1973 | Lafond | |
| 3,839,805 | A | 10/1974 | Stepe | |
| 3,982,339 | A | 9/1976 | Nilsson | |
| 4,028,823 | A * | 6/1977 | Edwards et al. | 37/452 |
| 4,182,058 | A | 1/1980 | Poncin | |
| 4,231,173 | A | 11/1980 | Davis | |
| 4,233,761 | A | 11/1980 | Ryerson | |

(Continued)

FOREIGN PATENT DOCUMENTS

| | | |
|---|---|---|
| AU | 2003264586 | 7/2004 |
| AU | 2005203574 B2 | 3/2007 |

(Continued)

OTHER PUBLICATIONS

U.S. Appl. No. 13/497,989.

*Primary Examiner* — Jamie L McGowan
(74) *Attorney, Agent, or Firm* — Leydig, Voit & Mayer, Ltd.; John Augustyn

(57) ABSTRACT

A wear assembly having an adaptor with a spigot portion is disclosed. The spigot portion has a transverse dimension. The wear assembly also has a wear member releasably mountable on the adaptor. The wear member has a body with a socket cavity and the socket cavity is adapted to receive the spigot portion of the adaptor. The wear member also has a pair of mounting ears extending from the body. Each of the mounting ears has a transverse dimension. The transverse dimension of each mounting ear is in the range 0.25 to 0.4 of the transverse dimension of the spigot portion.

30 Claims, 23 Drawing Sheets

(56) References Cited

U.S. PATENT DOCUMENTS

| | | | | | |
|---|---|---|---|---|---|
| 4,335,532 | A | | 6/1982 | Hahn et al. | |
| 4,338,736 | A | | 7/1982 | Radigan | |
| 4,404,760 | A | | 9/1983 | Hahn et al. | |
| 4,481,728 | A | | 11/1984 | Mulder et al. | |
| 4,587,751 | A | | 5/1986 | Sjogren et al. | |
| 4,903,420 | A | | 2/1990 | Kreitzberg et al. | |
| 5,088,214 | A | | 2/1992 | Jones | |
| 5,172,501 | A | | 12/1992 | Pippins | |
| 5,177,886 | A | * | 1/1993 | Klett | 37/452 |
| 5,272,824 | A | | 12/1993 | Cornelius | |
| 5,337,495 | A | | 8/1994 | Pippins | |
| 5,423,138 | A | | 6/1995 | Livesay et al. | |
| 5,456,029 | A | * | 10/1995 | Cornelius | 37/456 |
| 5,469,648 | A | | 11/1995 | Jones et al. | |
| 5,561,925 | A | * | 10/1996 | Livesay | 37/455 |
| 5,653,048 | A | | 8/1997 | Jones et al. | |
| 5,709,043 | A | | 1/1998 | Jones et al. | |
| 5,806,215 | A | * | 9/1998 | Matthews | 37/452 |
| 5,918,391 | A | * | 7/1999 | Vinas Peya | 37/452 |
| 5,937,550 | A | | 8/1999 | Emrich | |
| 6,018,896 | A | | 2/2000 | Adamic | |
| 6,052,927 | A | | 4/2000 | Pippins | |
| 6,119,378 | A | | 9/2000 | Pippins | |
| 6,467,203 | B2 | | 10/2002 | Pippins | |
| 6,467,204 | B1 | | 10/2002 | Creighton et al. | |
| 6,477,796 | B1 | * | 11/2002 | Cornelius | 37/452 |
| 6,735,890 | B2 | | 5/2004 | Carpenter et al. | |
| 7,100,315 | B2 | | 9/2006 | Carpenter et al. | |
| 7,578,081 | B2 | * | 8/2009 | Bearden et al. | 37/455 |
| 7,788,830 | B2 | | 9/2010 | Woerman et al. | |
| 2002/0000053 | A1 | | 1/2002 | Adamic et al. | |
| 2003/0061744 | A1 | * | 4/2003 | Leslie et al. | 37/452 |
| 2003/0140531 | A1 | | 7/2003 | Pippins | |
| 2004/0010949 | A1 | * | 1/2004 | Laguarda et al. | 37/452 |
| 2004/0060208 | A1 | * | 4/2004 | Wagner | 37/452 |
| 2004/0107608 | A1 | | 6/2004 | Meyers et al. | |
| 2006/0265916 | A1 | * | 11/2006 | Carpenter et al. | 37/452 |
| 2007/0245601 | A1 | | 10/2007 | Bearden et al. | |
| 2012/0246982 | A1 | * | 10/2012 | Bentley | 37/456 |

FOREIGN PATENT DOCUMENTS

| | | | |
|---|---|---|---|
| CA | 2161505 | | 4/1997 |
| WO | WO 02/101160 | A1 | 12/2002 |
| WO | WO 2007/016719 | A1 | 2/2007 |

* cited by examiner

EXCAVATOR WEAR ASSEMBLY

FIELD OF THE INVENTION

The invention relates to an excavator wear member. In particular, although not exclusively, the invention relates to an excavator tooth and an adaptor.

BACKGROUND TO THE INVENTION

Excavator tooth assemblies mounted to the digging edge of excavator buckets and the like generally comprise a replaceable digging tooth, an adaptor body and an adaptor nose which is secured by welding or the like to the digging edge of a bucket or the like. The tooth generally has a socket-like recess at its rear end to receivably locate a front spigot portion of the adaptor nose and a removable locking pin is generally employed to releasably secure the tooth on the adaptor.

In use, excavator teeth are subjected to extensive load forces along a longitudinal axis of a tooth as well as in vertical and transverse directions. A snug fit is required between the digging point and the front portion of the adaptor and also between the adaptor socket and the nose spigot portion and their respective mounting pins to avoid premature wear between the components. As the various components wear, the locking pins can loosen thereby increasing the risk of loss of a digging point or an entire adaptor/tooth combination. This necessitates considerable downtime to replace the lost wear members and where items such as locking pins are not recovered, these can cause damage and/or further downtime in downstream operations such as ore crushing and the like.

The greatest loads experienced by excavator tooth assemblies are vertical loads which tend to generate large moment forces capable of rotating a tooth off the front of an adaptor and/or rotating the adaptor off the adaptor nose. In addition, twisting or "yaw" loads are frequently imposed on such tooth assemblies.

Despite many prior art attempts to improve the mounting of a wear member to a nose of an excavator, most of these proposals suffer from one or more deficiencies. As described hereinafter, many of the prior art references relate to direct mounting of a tooth onto a nose without an intermediate adaptor but in those assemblies, the mounting systems for securing teeth directly onto excavator noses is considered analogous to the mounting of a tooth onto an adaptor.

U.S. Pat. No. 4,182,058 describes an excavator tooth having a rearwardly divergent tapering socket to receive a nose having a complementary-shaped front spigot portion. Resistance to rotational moment forces is borne by a resilient steel cotter pin extending through aligned vertical apertures in the socket and spigot portions.

U.S. Pat. Nos. 3,774,324, 4,338,736, 4,481,728, 4,903,420, 5,469,648, 7,100,315 and 6,735,890 all describe nose and tooth combinations wherein the nose has a generally convergently tapering spigot portion with a forward tip having a box-like configuration with at least the upper and lower surfaces thereof having faces parallel to each other and to a longitudinal axis of the nose portion. With the exception of U.S. Pat. No. 4,338,736, which describes a transverse locking pin, each of the tooth mounting arrangements is heavily reliant on a large vertical locking pin to resist rotational moment forces tending to rotate the teeth off respective noses.

U.S. Pat. No. 4,231,173 describes a tapered adaptor nose having a box-like free end, which engages in a mating box-like socket cavity to resist rotational moments. Opposed pairs of rearwardly extending tongues engage in corresponding recesses in the outer surfaces of the adaptor nose to resist rotational movements. Because the tongues themselves are unsupported, they possess a limited capacity to resist rotational moment forces.

U.S. Pat. No. 5,272,824 describes a structure similar to that of U.S. Pat. No. 4,231,173 except that the side tongues are of more robust dimensions and the upper and lower tongues are formed as box-like members with apertures to receive a vertical mounting pin passing through aligned apertures in the tooth and adaptor nose.

U.S. Pat. No. 4,404,760 provides flat rail surfaces on the adaptor nose to engage with mating grooves in the socket aperture of a corresponding tooth wherein the mating rail and groove surfaces are generally parallel to the longitudinal axis of the tooth.

U.S. Pat. No. 5,423,138 describes a generally tapered nose having a box-like front end with upper and lower transverse surfaces generally parallel to a longitudinal axis of a tooth which located directly thereon. The parallel upper and lower transverse surfaces are contiguous with upper and lower rail surfaces on each side of the nose and parallel to the longitudinal axis of the tooth. A pair of rearwardly extending side tongues locate in recesses formed in the outer side faces of the nose, ostensibly to resist rotational moment forces in the tooth. Because the side tongues are recessed to accommodate the side rail portions, the robustness of the side tongues is somewhat compromised.

U.S. Pat. No. 4,233,761 describes a fairly stubby tapered nose having a box-like front portion with upper and lower surfaces generally parallel to a longitudinal axis of an excavator tooth, an intermediate rearwardly diverging tapered portion and a rear portion having upper and lower surfaces extending generally parallel to a longitudinal axis of the tooth. Formed on the upper and lower surfaces of the front, intermediate and rear portions of the nose are spaced parallel reinforcing ribs which are located in mating grooves in the excavator tooth. A large vertical locking pin extends through aligned apertures in the tooth and nose between the reinforcing ribs. This structure is heavily reliant on the locking pin to resist rotational moment forces however it is considered that this configuration may be prone to failure in the rear portion of the adaptor.

U.S. Pat. No. 5,709,043 describes a nose/adaptor combination wherein the adaptor socket tapers convergently towards a box-like front portion having upper and lower bearing surfaces generally parallel to a longitudinal axis of the tooth, a front transverse upright bearing surface and rearwardly divergent bearing surfaces formed at obtuse angles between the converging upper and lower walls and the side walls of the socket, ostensibly to avoid areas of stress concentration.

U.S. Pat. No. 6,018,896 describes a pin/retainer system for locking an excavation tooth onto an adaptor wherein the retainer is inserted in the adaptor and a wedge-shaped pin is driven into aligned apertures in the tooth and adaptor to resiliently engage with the retainer.

United States Publication No US 2002/0000053A1 describes a mechanism for releasably retaining an adaptor into the nose of a bucket lip or the like wherein a tapered threaded socket is non-rotatably located on the inside of an aperture in the side wall of the adaptor. A threaded retaining pin extends through the threaded socket and locates in an aligned aperture in the bucket nose.

U.S. Pat. No. 5,337,495 describes a tooth assembly with a two-piece telescopically engageable adaptor secured to a nose with a tapered wedge pin assembly. A similar mounting system is described in U.S. Pat. No. 5,172,501 and U.S. Pat. No. 6,052,927. Other retention systems for digging points on adaptors or adaptors on noses are described in U.S. Pat. Nos. 6,119,378, 6,467,204, and 6,467,203.

Other devices for removably securing replaceable wear elements on earth working equipment such as a retaining pin, a bolt, a pin lock and locking blocks engageable in a top aperture in a wear member are described in U.S. Pat. Nos. 3,839,805, 3,982,339, 4,587,751, 5,088,214 and 5,653,048 respectively.

U.S. Pat. No. 5,937,550 describes a lock assembly for releasably securing an adaptor to a nose of an excavator support structure. The lock assembly comprises a body and a base coupled together and adapted for insertion, while coupled together, in a hole in the nose of the support structure. The length of the lock assembly is extended to secure the adaptor and is retracted to release the adaptor. While adequate for securing an adaptor to a nose of an excavator support structure, the lock described in this patent is relatively complex in design and operation leading to high costs and labour intensive extraction procedures in the field.

Canadian Patent Application No 2,161,505 describes a system for removably retaining an excavation point on an adaptor with at least one flanged sleeve having a screw-threaded aperture therein, the flanged sleeve being non-rotatably locatable in a transverse bore in the adaptor before fitment of the point onto the adaptor. A screw-threaded pin is inserted into the sleeve via an aperture in the point whereby portion of the head of the pin retains the point on the adaptor.

Australian Patent Application No 2003264586 describes a locking pin assembly comprising a body member having a non-circular cross-sectional shape locatable in a bore of complementary shape extending laterally between opposite sides of an excavator lip mounting nose. After locating the body member in the nose aperture, an adaptor can be engaged over the nose with apertures in opposite side walls aligned with the body member. Threaded bolts engage in threaded apertures in opposite ends of the body member, the bolts each having a tapered shank portion with an enlarged boss at a free end thereof, the boss being locatable in a respective aperture in a side wall of said adaptor to prevent the adaptor from disengaging with the nose.

While generally satisfactory for their intended purpose, the abovementioned prior art all suffer from one or more shortcomings or disadvantages in terms of inadequate resistance to rotation of a tooth off a nose or an adaptor under the influence of vertical loads applying a rotational moment to the tooth, a predisposition to premature wear, difficulties in retention of the teeth on noses or adaptors, inadequate locking systems and unduly complicated configurations giving rise to increased fabrication costs.

Furthermore, the prior art all generally rely on lock assemblies that require threaded components. Thread components in lock assemblies are generally disadvantageous as dirt and, fines can infiltrate the threaded assembly thereby causing cementation and resulting in difficulties in removal.

OBJECT OF THE INVENTION

It is an object of the invention to overcome or at least alleviate one or more of the above problems and/or provide the consumer with a useful or commercial choice.

DISCLOSURE OF THE INVENTION

In one form, although it need not be the only or indeed the broadest form, the invention resides in an excavator wear assembly comprising:

an adaptor having a spigot portion, the spigot portion having a transverse dimension;

a wear member releasably mountable on the adaptor, the wear member having a body with a socket cavity, the socket cavity adapted to receive the spigot portion of the adaptor, the wear member further including a pair of mounting ears extending from the body, each of the mounting ears having a transverse dimension;

wherein, the transverse dimension of each mounting ear is in the range 0.25 to 0.4 of the transverse dimension of the spigot portion.

More preferably, the transverse dimension of each mounting ear is in the range 0.26 to 0.39 of the transverse dimension of the spigot portion.

More preferably, the transverse dimension of each mounting ear is in the range 0.27 to 0.38 of the transverse dimension of the spigot portion.

More preferably, the transverse dimension of each mounting ear is in the range 0.28 to 0.37 of the transverse dimension of the spigot portion.

More preferably, the transverse dimension of each mounting ear is in the range 0.29 to 0.36 of the transverse dimension of the spigot portion.

More preferably, the transverse dimension of each mounting ear is in the range 0.3 to 0.35 of the transverse dimension of the spigot portion.

More preferably, the transverse dimension of each mounting ear is in the range 0.31 to 0.34 of the transverse dimension of the spigot portion.

More preferably, the transverse dimension of each mounting ear is 0.32 of the transverse dimension of the spigot portion.

More preferably, the transverse dimension of each mounting ear is 0.33 of the transverse dimension of the spigot portion.

More preferably, the transverse dimension of each mounting ear is one third of the transverse dimension of the spigot portion.

Suitably, the transverse dimension of each mounting ear is a distance from an outer face of the respective mounting ear to an inner face thereof.

Suitably, the inner face of each mounting ear is adapted to oppose and engage a respective sidewall of the spigot portion of the adaptor.

Suitably, the transverse dimension of the spigot portion is a distance between opposed sidewalls thereof.

Typically, the wear member is a digging tooth.

In a further form, the excavator wear assembly, the wear member comprising:

a body with a socket cavity; the socket cavity having a transverse dimension;

a pair of mounting ears extending from the body, each of the mounting ears having a transverse dimension; and wherein, the transverse dimension of each mounting ear is in the range 0.25 to 0.4 of the transverse dimension of the socket cavity.

More preferably, the transverse dimension of each mounting ear is in the range 0.26 to 0.39 of the transverse dimension of the socket cavity.

More Preferably, the transverse dimension of each mounting ear is in the range 0.27 to 0.38 of the transverse dimension of the socket cavity.

More preferably, the transverse dimension of each mounting ear is in the range 0.28 to 0.37 of the transverse dimension of the socket cavity.

More preferably, the transverse dimension of each mounting ear is in the range 0.29 to 0.36 of the transverse dimension of the socket cavity.

More preferably, the transverse dimension of each mounting ear is in the range 0.3 to 0.35 of the transverse dimension of the socket cavity.

More preferably, the transverse dimension of each mounting ear is in the range 0.31 to 0.34 of the transverse dimension of the socket cavity.

More preferably, the transverse dimension of each mounting ear is 0.32 of the transverse dimension of the socket cavity.

More preferably, the transverse dimension of each mounting ear is 0.33 of the transverse dimension of the socket cavity.

More preferably, the transverse dimension of each mounting ear is one third of the transverse dimension of the socket cavity.

Suitably, the transverse dimension of the socket cavity is a distance between an inner face of the first mounting ear of the pair of mounting ears and an inner face of the second mounting ear of the pair of mounting ears.

Suitably, the transverse dimension of each mounting ear is a distance from an outer face of the respective mounting ear to an inner face thereof.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

DETAILED DESCRIPTION OF THE INVENTION

The excavator wear assembly and lock assembly therefore are described with reference to an excavator wear member in the form of a tooth releasably secured to an adaptor. The adaptor is in turn secured to a nose of an excavator bucket or the like. A skilled addressee will appreciate that the invention may be employed to releasably secure an adaptor to a nose or a tooth directly to a nose of an excavator bucket lip.

Furthermore, the lock assembly may be utilized in other applications such as a retaining pin for components in dragline excavator rigging and the like.

Figure 1A:
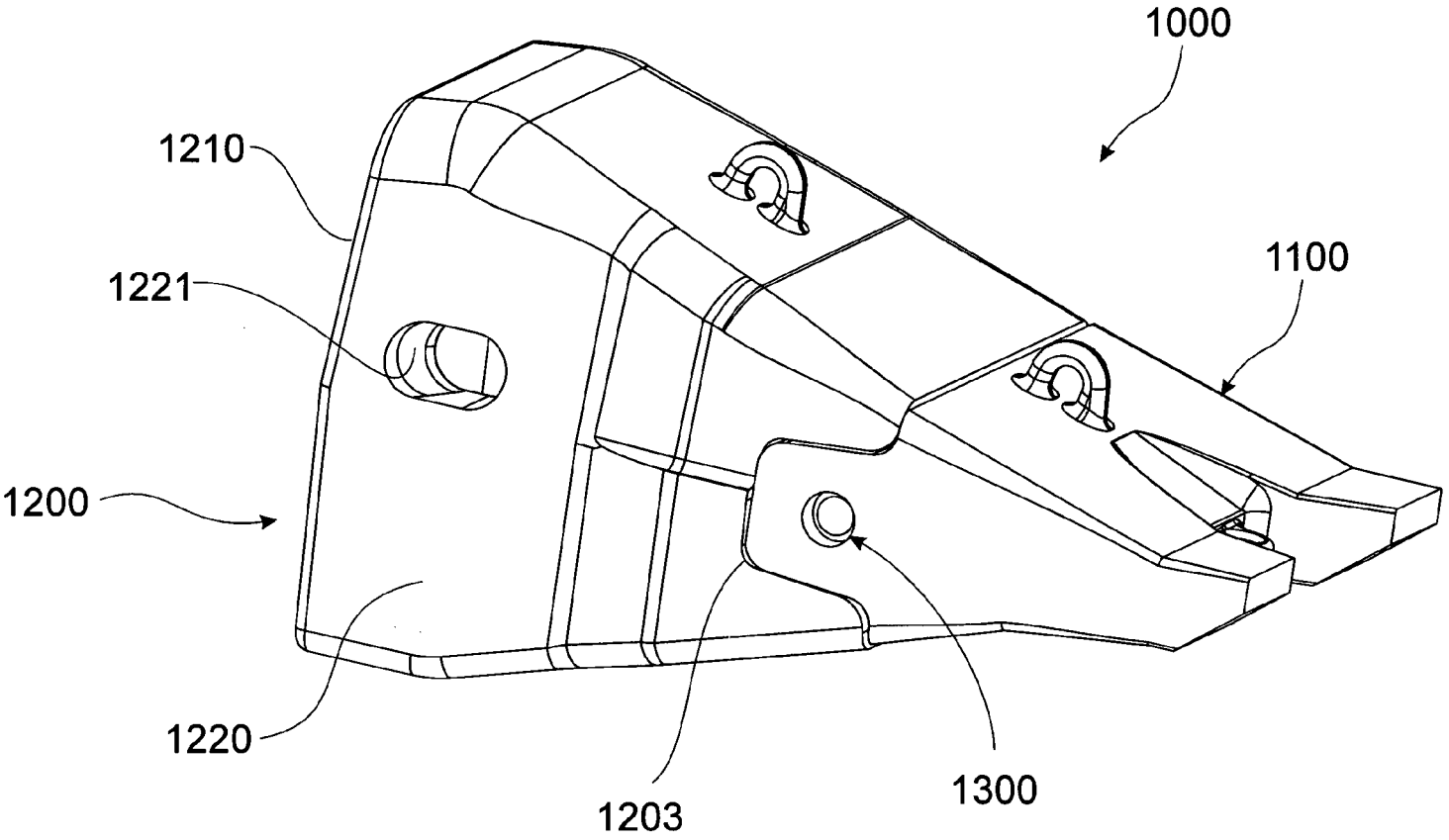
FIG. 1A shows a perspective view of an excavator wear assembly according to an embodiment of the invention.
Figure 1B:
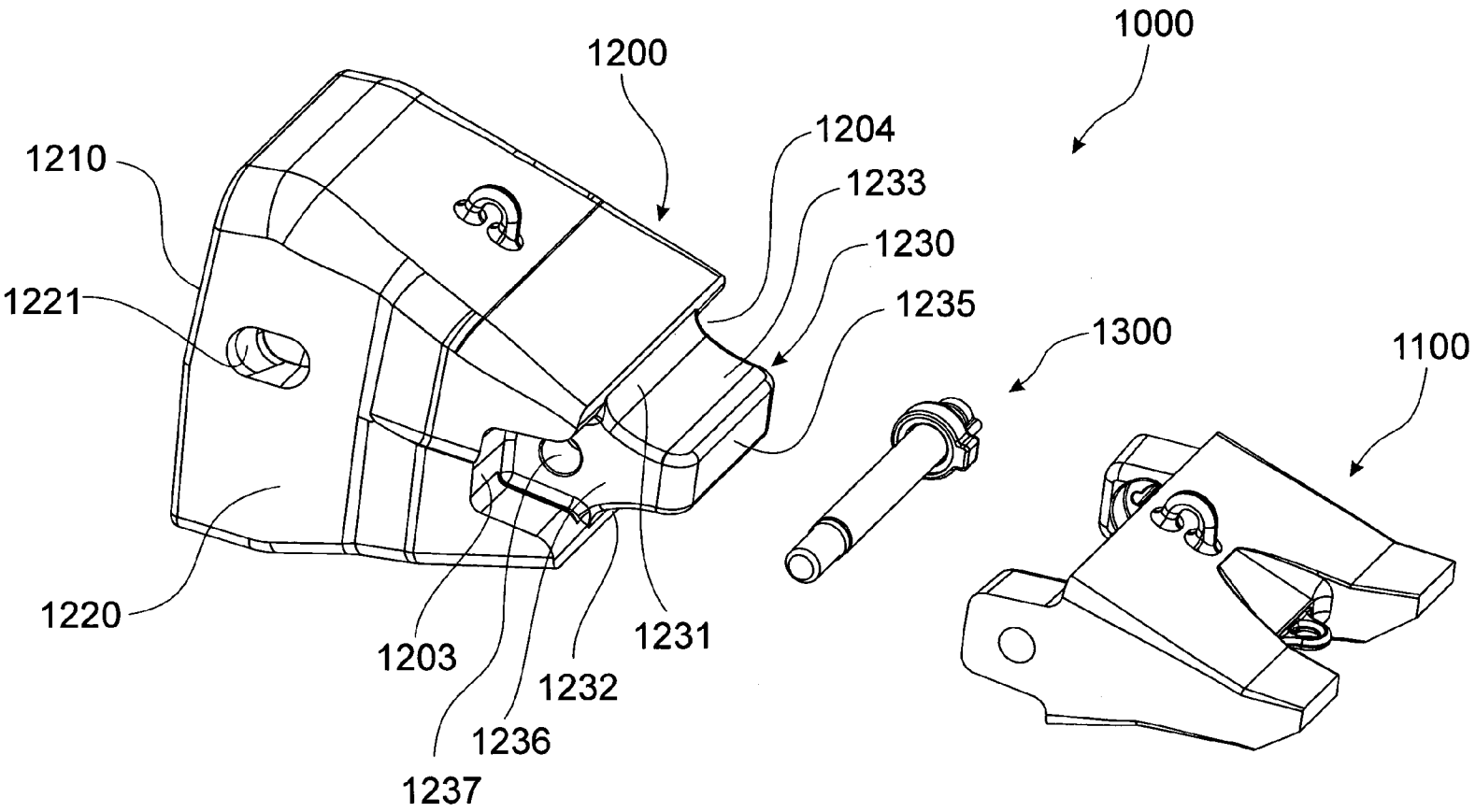
FIG. 1B shows an exploded perspective view of the excavator wear assembly shown in FIG. 1A.

FIG. 1A shows a perspective view of an excavator wear assembly 1000 according to an embodiment of the invention. FIG. 1B shows an exploded perspective view of the excavator wear assembly 1000. Excavator wear assembly 1000 comprises a wear member in the form of a tooth 1100 mountable on an adaptor 1200 and a lock assembly 1300 adapted to releasably secure tooth 1100 on adaptor 1200 as will be discussed in greater detail below.

Adaptor 1200 is suitably configured for mounting on a digging edge of an excavator by way of an adaptor socket 1210. Adaptor socket 1210 is formed in a shape complimentary with a nose of an excavator digging edge (not shown).

Adaptor 1200 has aligned transverse apertures 1221 each extending through a respective opposed side wall 1220. Aligned transverse apertures 1221 are adapted to receive an adaptor retaining pin (not shown) which extends through aligned transverse apertures 1221 and an adaptor retaining pin passage in the complimentary shaped nose (not shown) to thereby retain the adaptor 1200 on the excavator digging edge.

Additionally, adaptor 1200 has a pair of side wall mounting recesses 1203 and 1204 located in a forward portion of respective opposed side wall 1220.

Adaptor 1200 further includes a spigot portion 1230 extending from a forward portion thereof. Spigot portion 1230 has converging upper and lower rear bearing surfaces 1231, 1232 which terminate at substantially parallel upper and lower forward bearing surfaces 1233, 1234 respectively.

A front bearing face 1235 is disposed between upper forward bearing surface 1233 and lower forward bearing surface 1234.

Spigot portion 1230 also has a retaining passage 1237 extending therethrough between opposed side walls 1236 thereof.

Figure 2A:
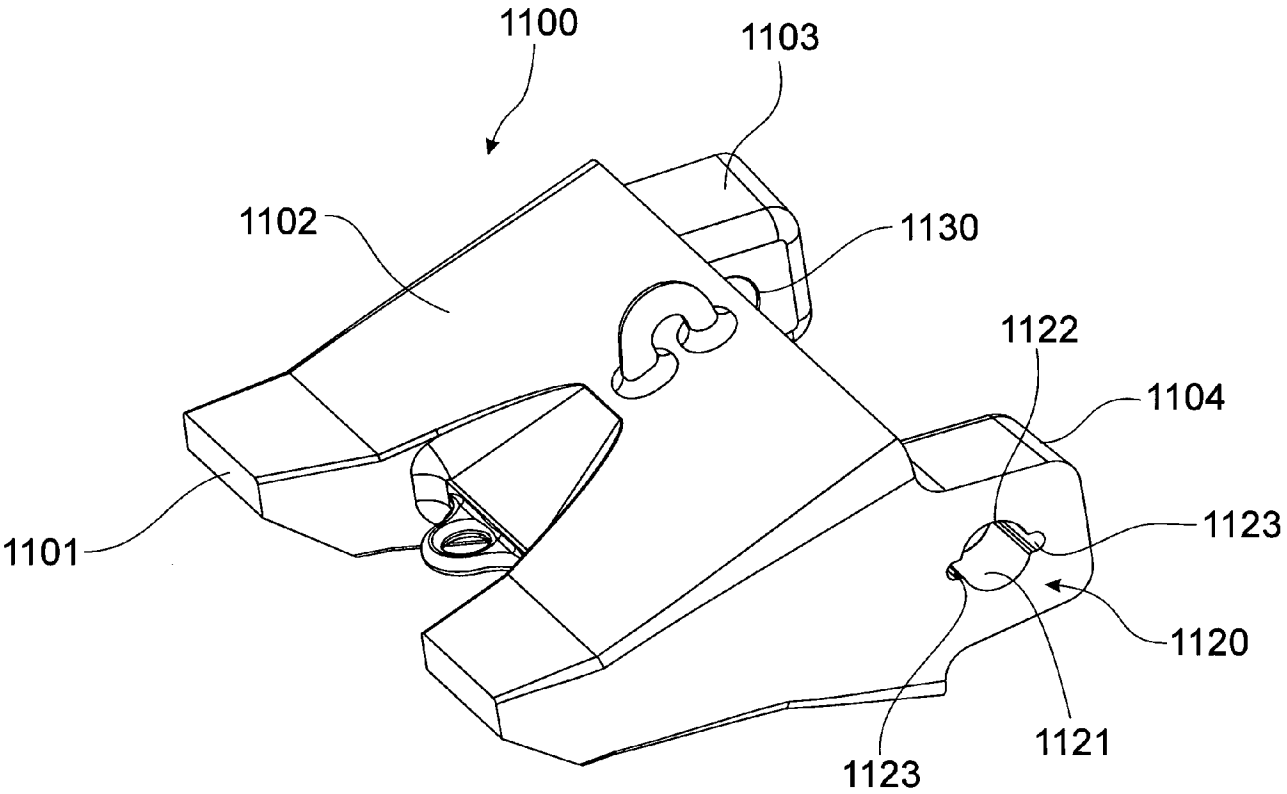
FIG. 2A shows a reverse perspective view of a tooth forming part of the excavator wear assembly shown in FIG. 1A.
Figure 2B:
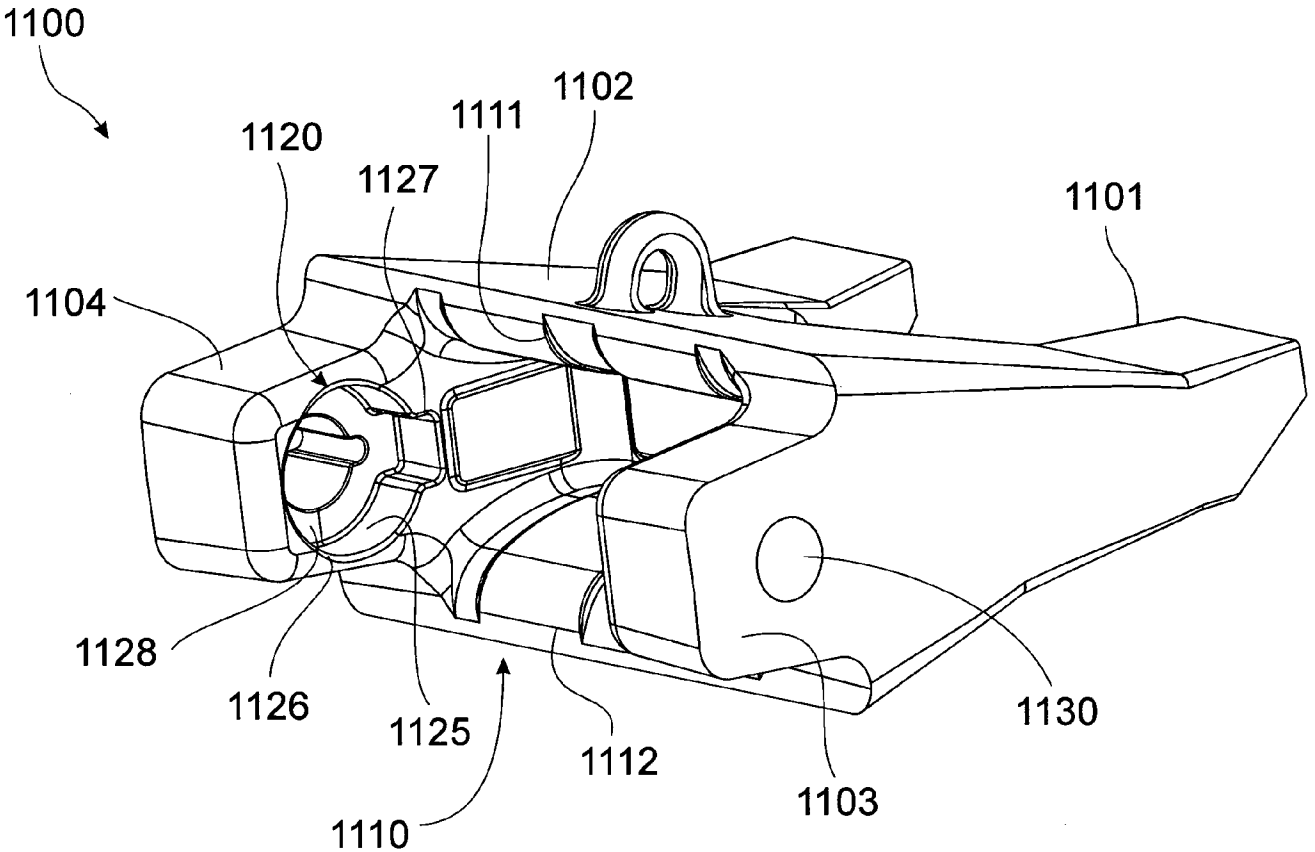
FIG. 2B shows a rear perspective view of the tooth shown in FIG. 2A
Figure 2C:
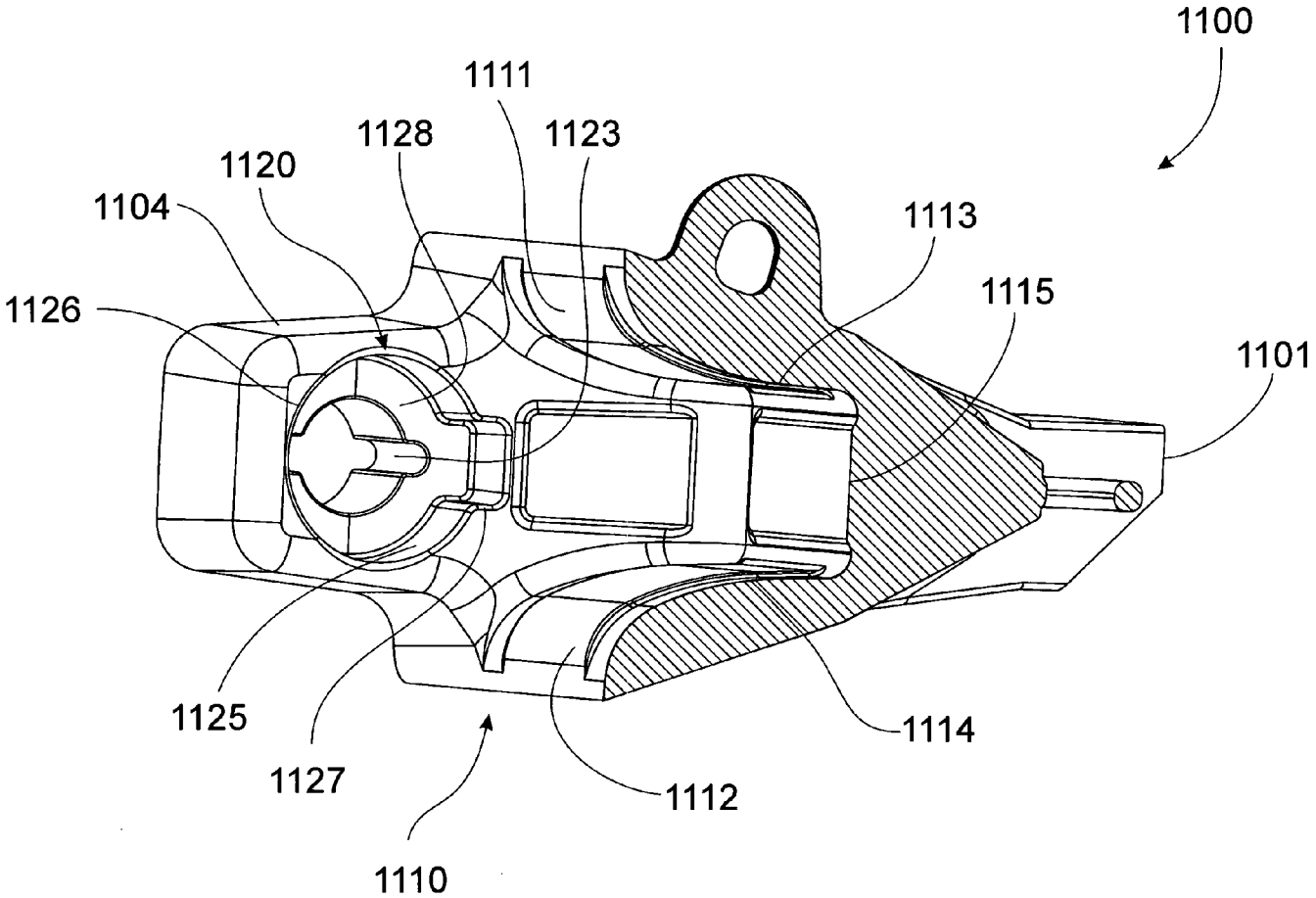
FIG. 2C shows a sectional perspective view of the tooth shown in FIG. 2A.

FIG. 2A shows a reverse perspective view of wear member in the form of tooth 1100. FIG. 2B shows a rear perspective view of the tooth 1100 and FIG. 2C shows a sectional perspective view of the tooth 1100.

Tooth 1100 has a forwardly projecting working end 1101 and a socket cavity 1110 formed from converging upper and lower rear bearing surfaces 1111 and 1112 respectively. Each of upper and lower bearing surfaces 1111 and 1112 terminate at substantially parallel upper and lower forward bearing surfaces 1113 and 1114 respectively. A front bearing face 1115 is disposed between upper forward bearing surface 1113 and lower forward bearing surface 1114.

Bearing surfaces 1111, 1112, 1113, and 1114 and front bearing face 1115 of tooth socket 1110 are configured to be complimentary with bearing surfaces 1231, 1232, 1233 and 1234 and front bearing face 1235 respectively of spigot portion 1230 of adaptor 1200. Socket cavity 1110 is adapted to receive spigot portion 1230 of adaptor 1200.

Tooth 1100 further includes mounting ears 1103 and 1104 extending rearwardly of tooth body 1102 from opposed sides thereof. In use, mounting ears 1103 and 1104 are adapted to be located within mounting recesses 1203 and 1204 respectively of adaptor 1200.

Additionally, a toe aperture 1130 extends through mounting ear 1103 and a locking aperture 1120 extends through opposed mounting ear 1104 as shown. In use, toe aperture 1130 and locking aperture 1120 are adapted to at least partially align with retaining passage 1237 of adaptor 1200.

Toe aperture 1130 is generally circular in cross section and extends through mounting ear 1103 as shown.

Locking aperture 1120 extends through mounting ear 1104 and is formed from a receiving passage 1121 and a retaining recess 1125. Optionally, locking aperture 1120 may extend through any wall of the tooth 1100

Receiving passage 1121 extends inwardly from an outer face of tooth 1100 and terminates at retaining recess 1125 located on an inner face of mounting ear 1104.

Receiving passage 1121 has a generally circular main portion 1122 and a pair of slots 1123 extending outwardly from diametrically opposed sides thereof.

Retaining recess 1125 has a generally circular main portion 1126 and a blind slot 1127 extending outwardly from circular main portion 1126. Circular main portion 1126 of retaining recess 1125 is concentric with circular main portion 1122 of receiving passage 1121 with circular main portion 1126 having a relatively larger diameter thereby forming a locking face 1128 at an inner end of retaining recess 1125.

Similarly, blind slot 1127 generally corresponds with one of slots 1123 of receiving passage 1123 with blind slot 1127 having a relatively larger cross sectional area than each of slots 1123.

Figure 3A:
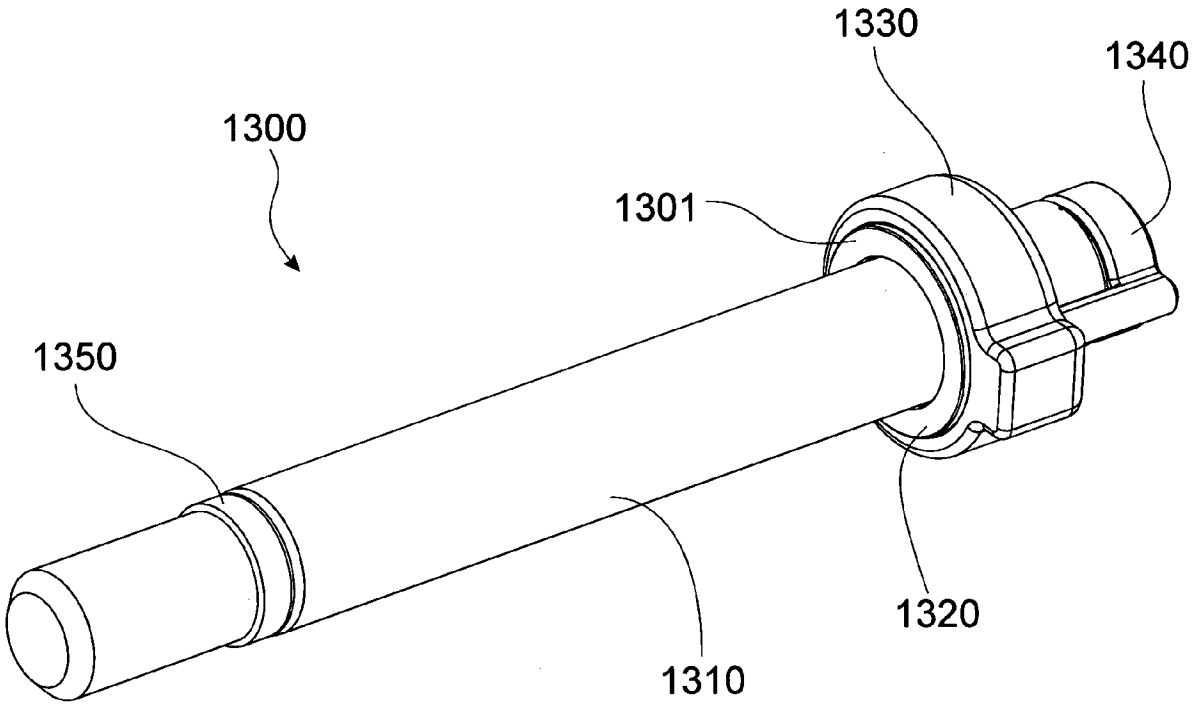
FIG. 3A shows a perspective view of a lock assembly shown in FIG. 1A.
Figure 3B:
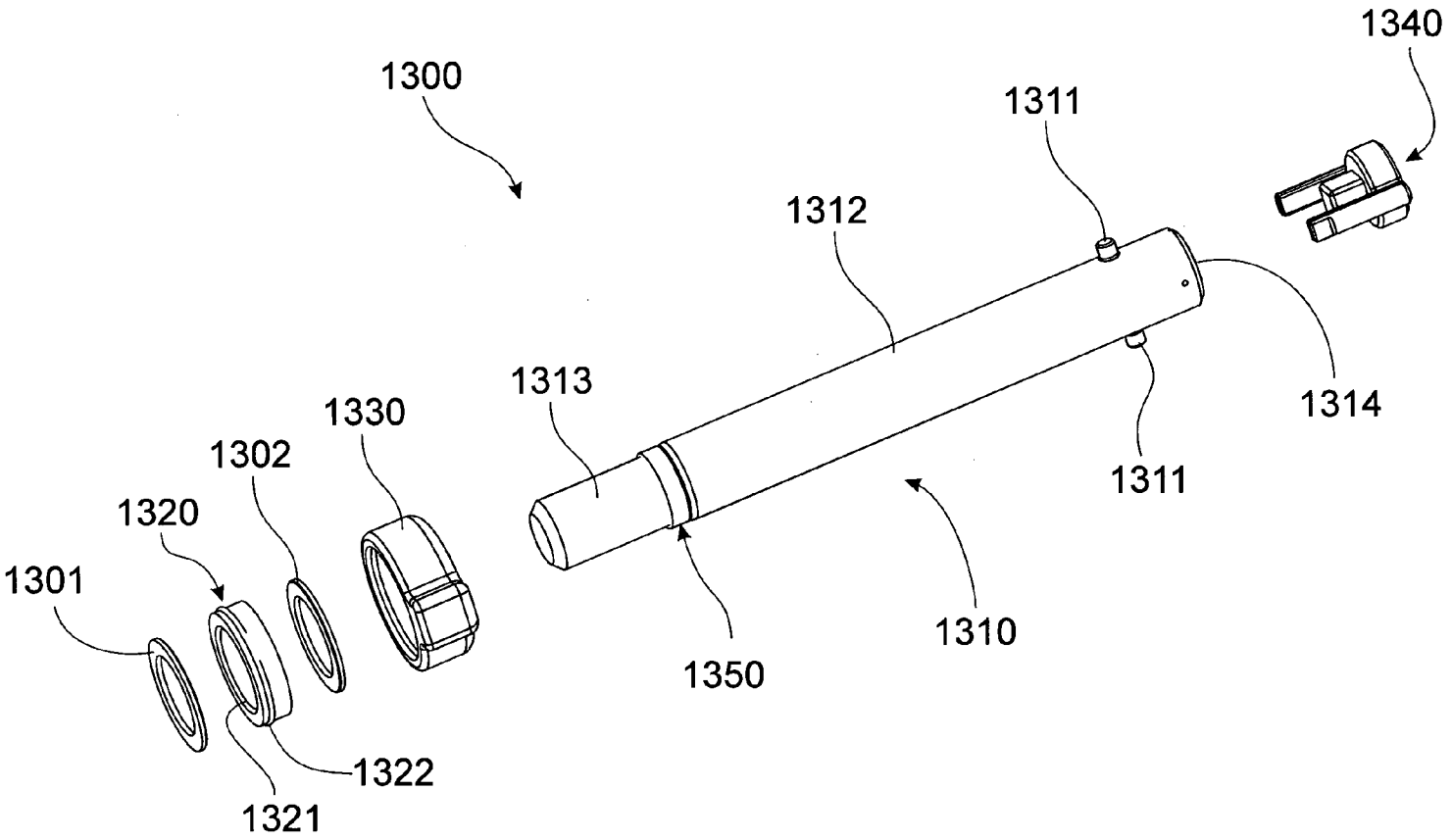
FIG. 3B shows an exploded perspective view of the lock assembly shown in FIG. 3A.

FIG. 3A shows a perspective view of lock assembly 1300 in a locked position and FIG. 3B shows an exploded perspective view of lock assembly 1300.

Lock assembly 1300 comprises a locking pin 1310, a biasing member 1320, a retaining member 1330, a keeper 1340 and a compression washer 1350. Lock assembly further comprises a pair of washers 1301,1302 adapted to locate against opposed faces of biasing member 1320.

Locking pin 1310 has a main portion 1312 and a pair of dowels 1311 extending outwardly from main portion 1312 and an end thereof from diametrically opposed sides thereof. Dowels 1311 are adapted to be received through respective slots 1123 of receiving passage 1121 as will be discussed in greater detail below.

Locking pin 1310 also has a toe portion 1313 extending from an end of main portion 1312 distal dowels 1311. Locking pin 1310 further comprises a recess 1314 (not shown in FIG. 3A or 3B) located in an end thereof adjacent dowels 1311.

Compression washer 1350 is securely located about toe portion 1313 adjacent main portion 1312.

Toe portion 1313 is adapted to be located in toe aperture 1130 of tooth 1100 as will be discussed in greater detail below.

Biasing member 1320 is generally circular in shape and has an aperture 1321 extending therethrough. Biasing member 1320 is formed from a resiliently deformable plastic or the like and is adapted to be located about main portion 1312 of locking pin 1310. Biasing member 1320 further includes an annular ridge 1322 extending circumferentially about an outer surface thereof.

In use, washers 1301, 1302 adapted to locate against opposed faces of biasing member 1320 such that washer 1302 bears against an inner surface of each dowel 1311 when locking assembly is in the locked position.

Figure 4A:
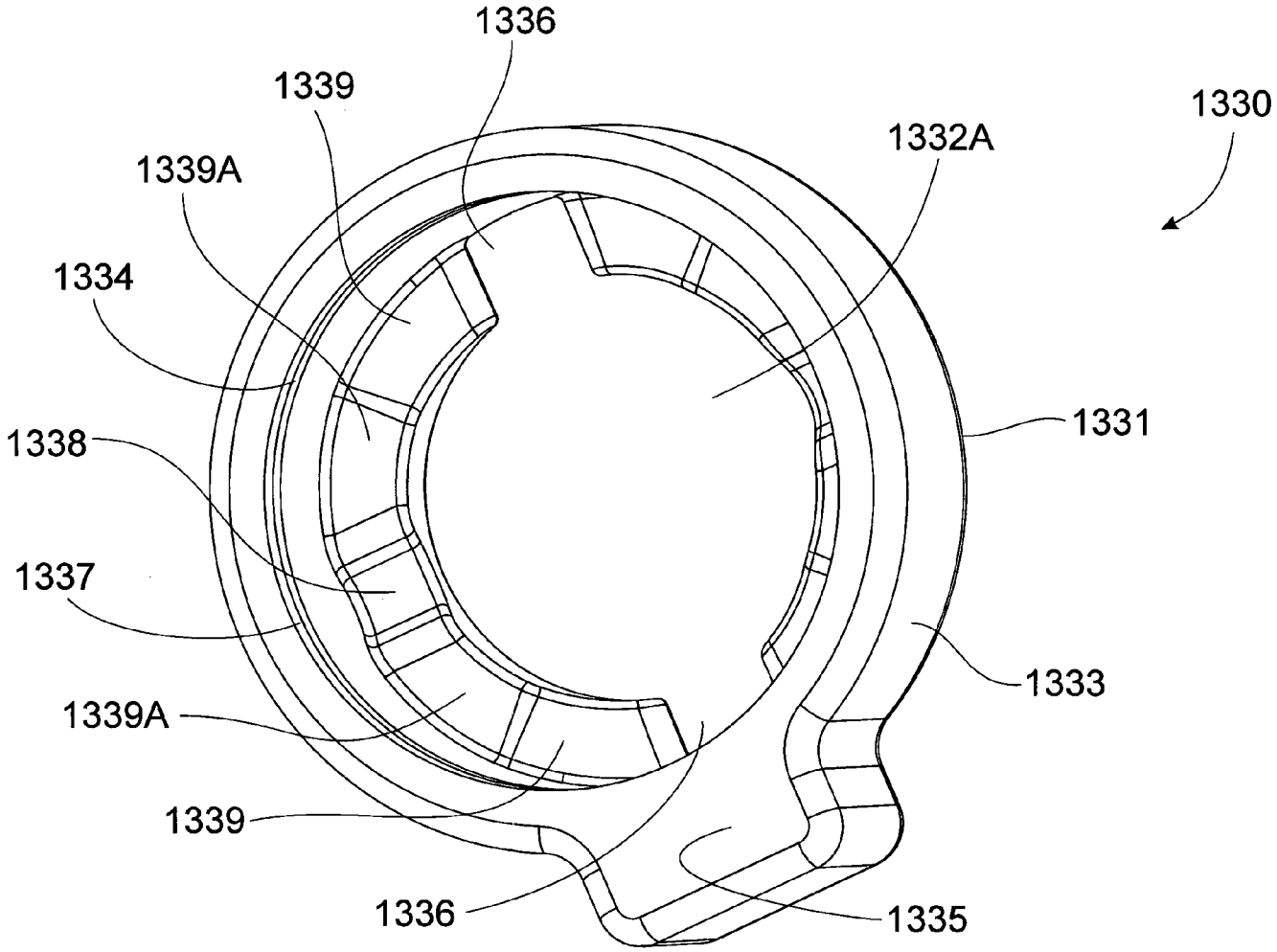
FIG. 4A shows an underside perspective view of a retaining member forming part of the lock assembly shown in FIG. 3A.
Figure 4B:
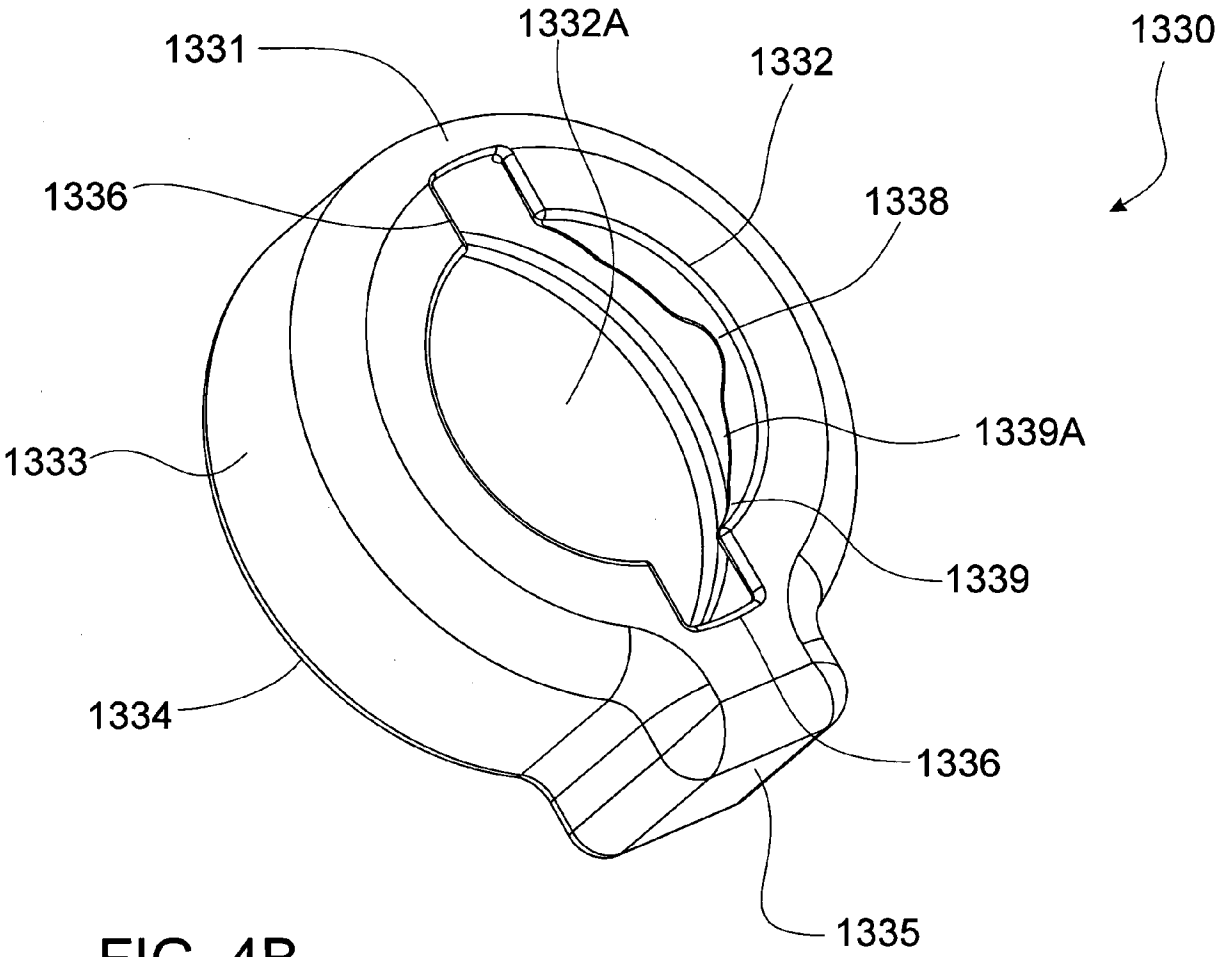
FIG. 4B shows a topside perspective view of the retaining member shown in FIG. 4A.

FIG. 4A shows an underside perspective view of retaining member 1330 and FIG. 4B shows a topside perspective view of retaining member 1330.

Retaining member has a body 1331 formed from a generally planar circular top surface 1332 having an aperture 1332A and an annular wall 1333 extending downwardly from top surface 1332 thereby forming a cavity 1334 adapted to locate biasing member 1320 therein as will be discussed further below. A detent 1335 extends outwardly from body 1331 as shown. Body 1331 is adapted to be received in circular main portion 1126 of retaining recess 1125 and detent 1335 is adapted to be received in blind slot 1127 of retaining recess 1125.

Retaining member 1330 further includes an annular valley 1337 extending circumferentially about an inner face of annular wall 1333 as shown.

A pair of slots 1336 are located on top surface 1332 such that slots are 1336 are diametrically opposed about top surface 1332. Slots 1336 are adapted to receive dowels 1311 of locking pin 1310.

A pair of seats 1338 are located on diametrically opposing sides of an underside of top surface 1332 as shown. Each seat 1338 is adapted to locate a dowel 1311 of locking pin 1310 when locking assembly 1300 is in the locked position.

Retaining member 1330 further includes a number of angled guide surfaces 1339 on an underside of top surface 1332 with each angled guide surface 1339 extending from a respective slot 1336 to a land 1339A such that each land 1339A is disposed between a respective angled guide surface 1339 and a seat 1338.

Suitably, each seat 1338 is axially offset from a slot 1336. Preferably, each seat is axially offset by 90 degrees from each slot 1336.

Figure 5:
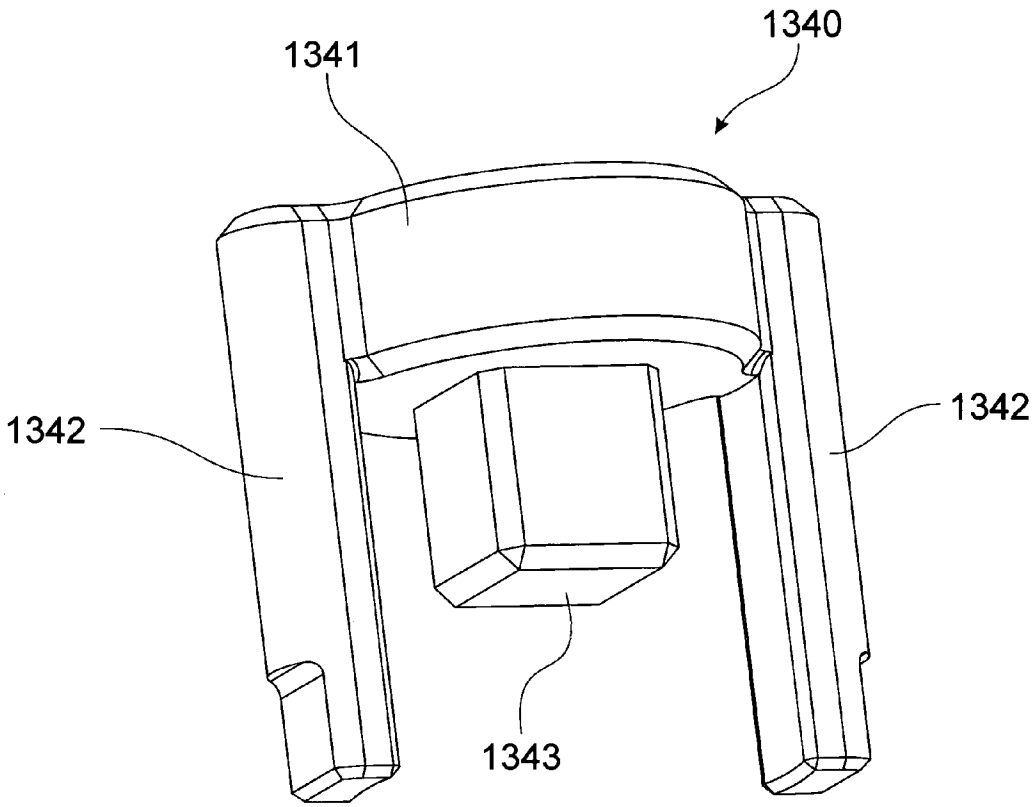
FIG. 5 shows a perspective view of a keeper forming part of the lock assembly shown in FIG. 3A.

FIG. 5 shows a perspective view of keeper 1340 forming part of locking assembly 1300.

Keeper 1340 has a generally circular top portion 1341 and a pair of legs 1342 extending from diametrically opposed sides of top portion 1341. Each leg 1342 is adapted to be received through a slot 1123 of receiving passage 1121 of tooth 1100 and terminate in a respective slot 1335 of retaining member 1330 when lock assembly 1300 is in the locked position.

Keeper 1340 further includes a plug 1343 extending from a central region of an underside of top portion 1341. Plug 1343 is adapted to be securely located within recess 1314 of locking pin 1310.

Lock assembly 1300 is adapted to releasably secure tooth 1100 on adaptor 1200.

Figure 6A:
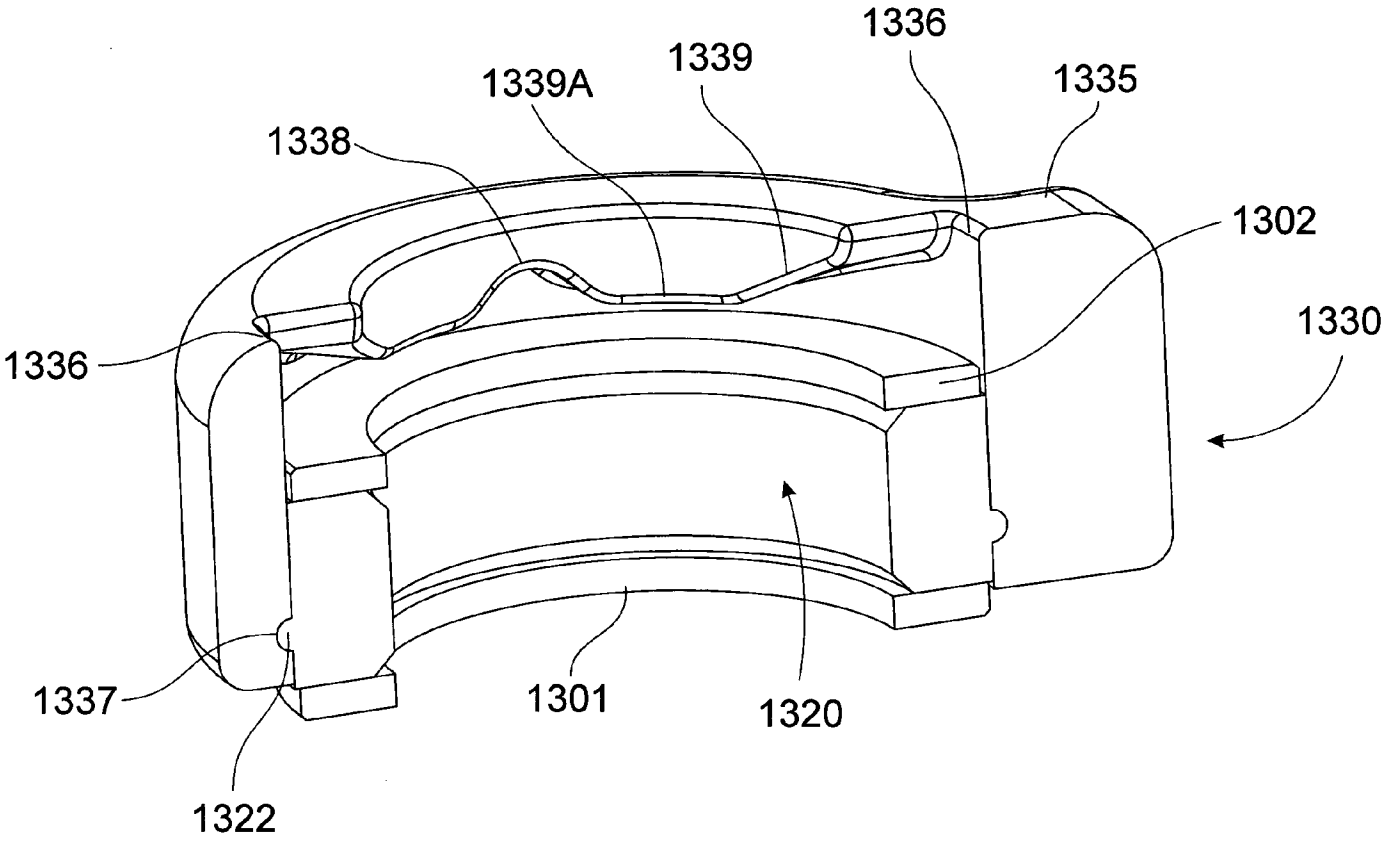
FIG. 6A shows a sectional perspective view of components of the lock assembly shown in FIG. 3A.
Figure 6B:
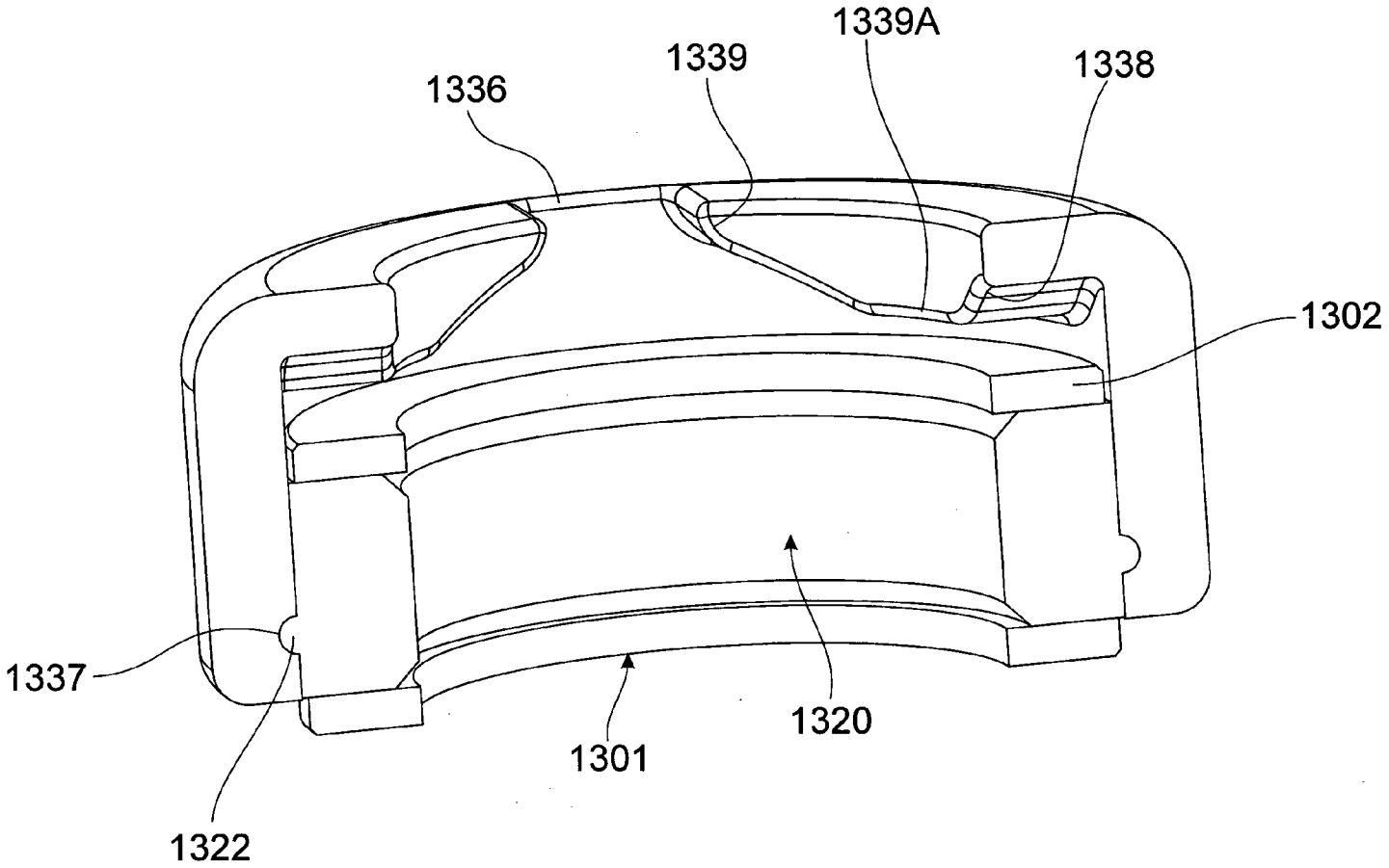
FIG. 6B shows a transverse sectional perspective view of components of the lock assembly shown in FIG. 3A.

FIG. 6A shows a sectional view of washers 1301, 1302 and biasing member 1320 located within cavity 1334 of retaining member 1330 and FIG. 6B shows a transverse sectional view of this arrangement.

As shown, annular ridge 1322 of biasing member 1320 is located within annular valley 1337 of retaining member 1330 such that biasing member 1320 is securely located within cavity 1334.

In a preferred embodiment, washers 1301, 1302 are non-removably secured to opposing faces of biasing member 1320 by means of an adhesive or the like.

In an optional embodiment, the biasing member 1320 may be permanently secured within cavity 1334 of retaining member 1330 by means of a chemical fastener or the like.

Figure 7A:
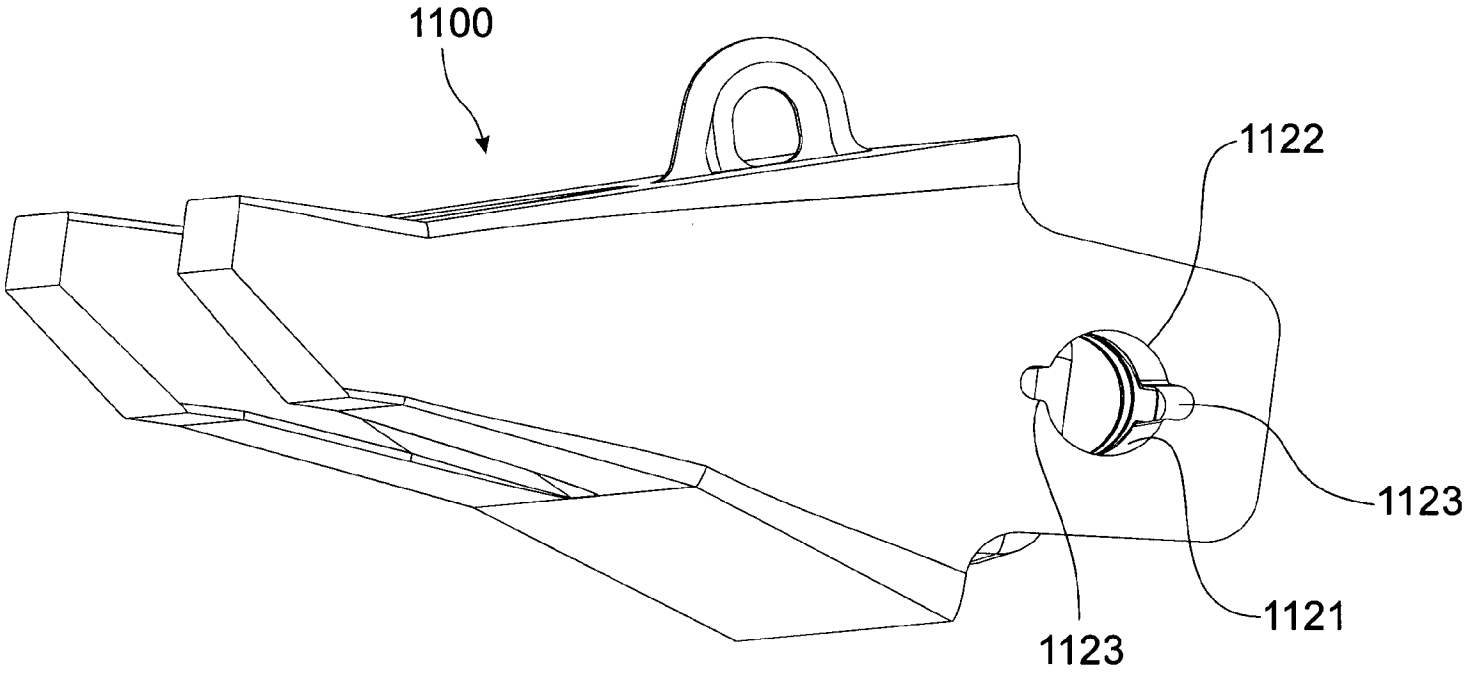
FIG. 7A shows a side perspective view of components of the locking assembly shown in FIG. 3A located within a tooth.
Figure 7B:
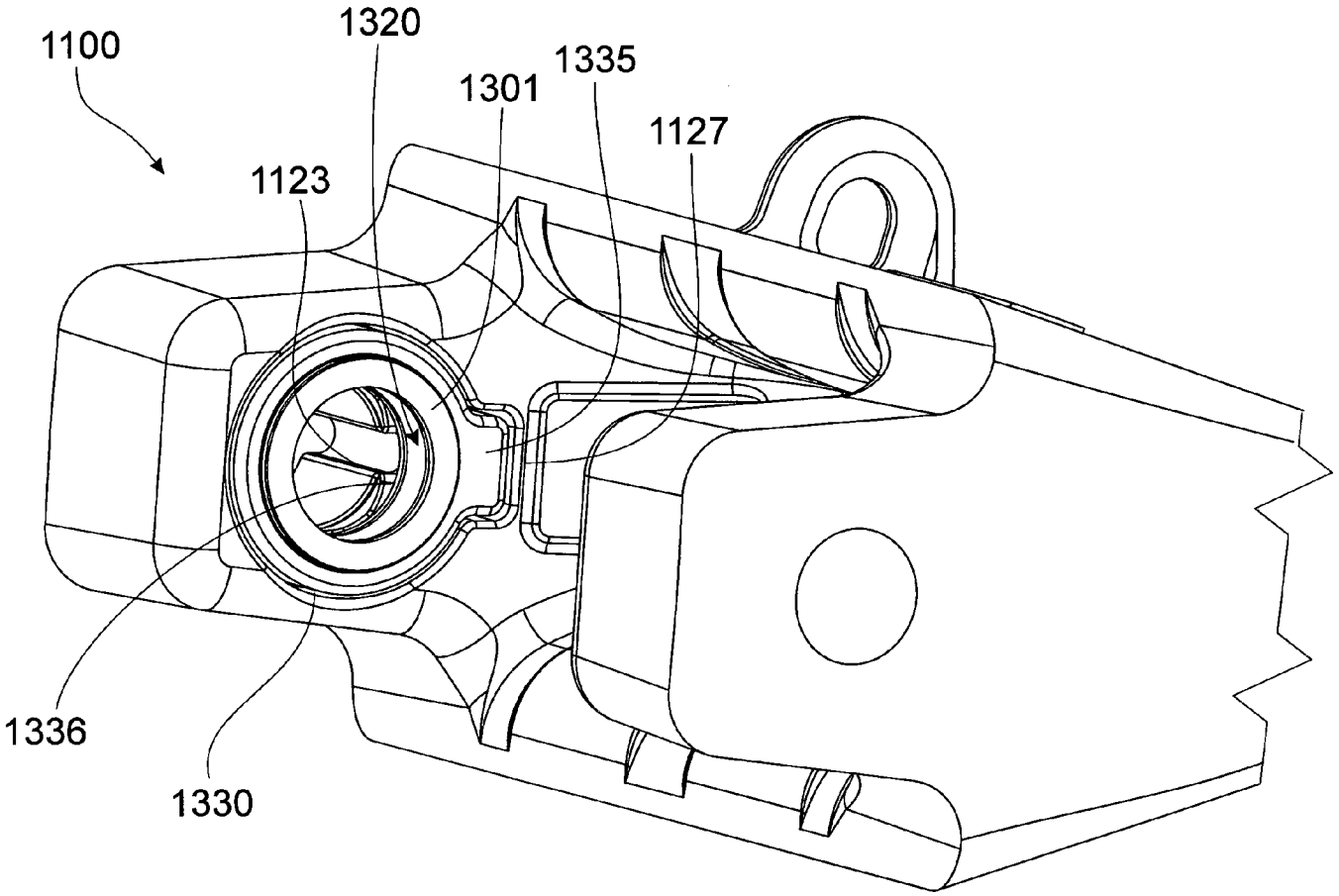
FIG. 7B shows a rear perspective view of the view shown in FIG. 7A.
Figure 7C:
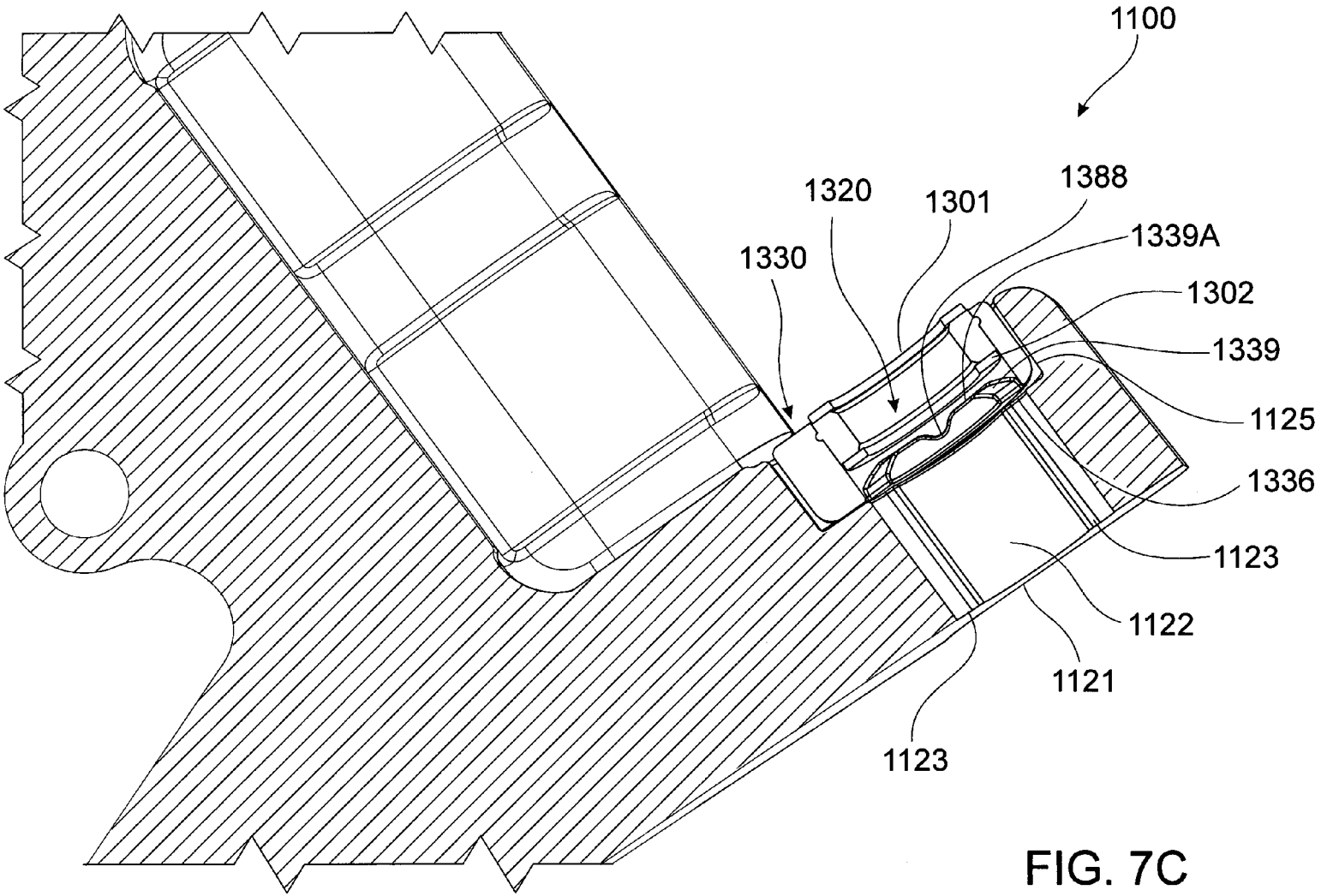
FIG. 7C shows a top sectional view of the view shown in FIG. 7A.

The retaining member 1330 is then located within retaining recess 1125 of locking aperture 1120 of tooth 1100 as shown in FIGS. 7A, 7B and 7C.

In this position, detent 1335 is located within blind slot 1127 thereby non-rotatably locating retaining member 1330 within retaining recess 1125. Furthermore, top surface 1332 of retaining member 1330 abuts locking face 1128 as shown.

Furthermore, slots 1336 of retaining member 1330 align with and correspond to slots 1123 of receiving passage 1121 of tooth 1100 as shown.

In an optional embodiment, retaining member 1330 may be permanently secured within retaining recess of locking aperture 1120 of tooth by means of a chemical fastener or the like such that tooth 1100 is provided in the arrangement as shown in FIGS. 7A-7C. Alternatively, retaining member 1330 may be integrally formed with tooth 1100.

Figure 8A:
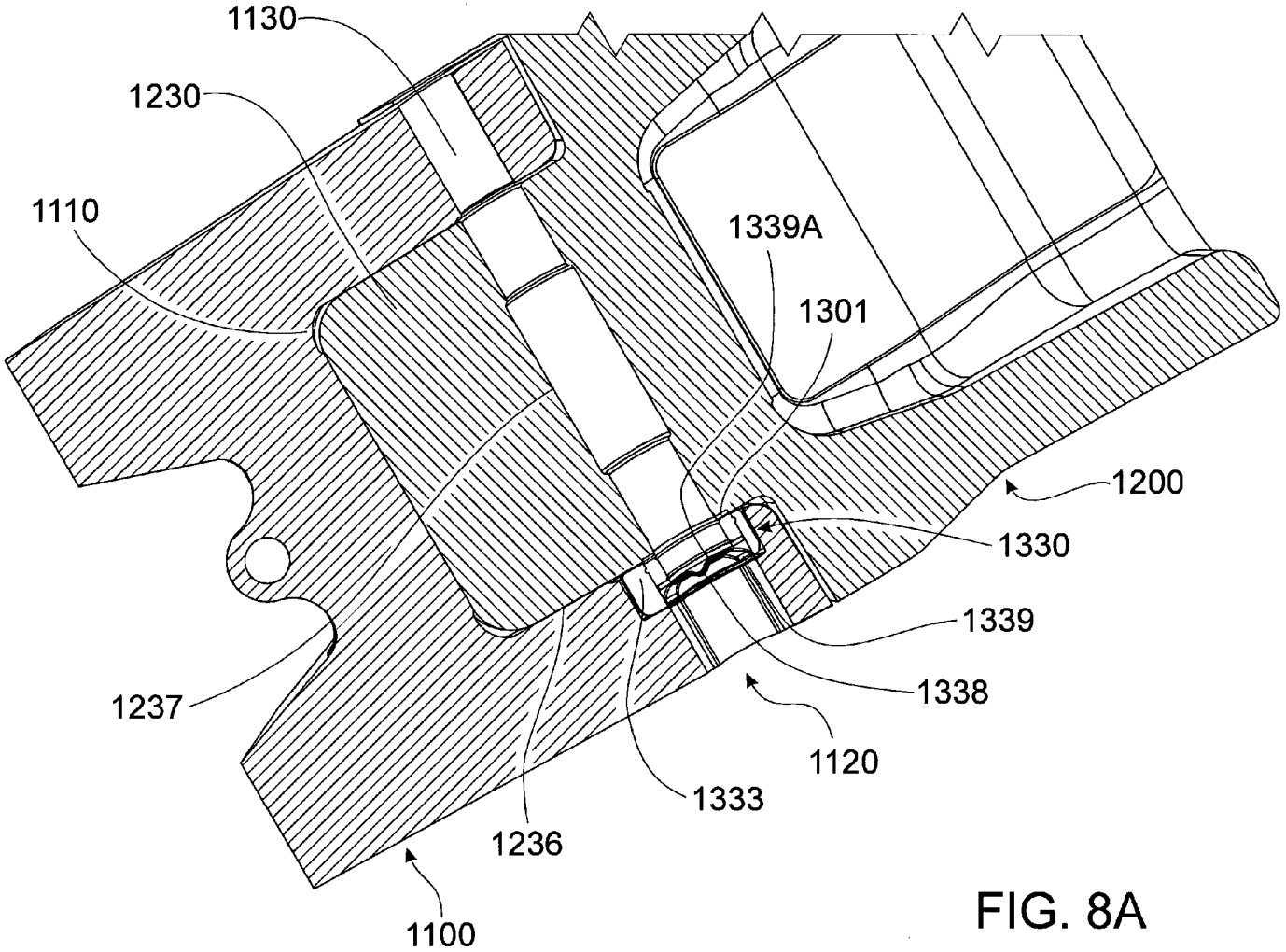
FIG. 8A shows a sectional perspective view of the tooth located on the adaptor.
Figure 8B:
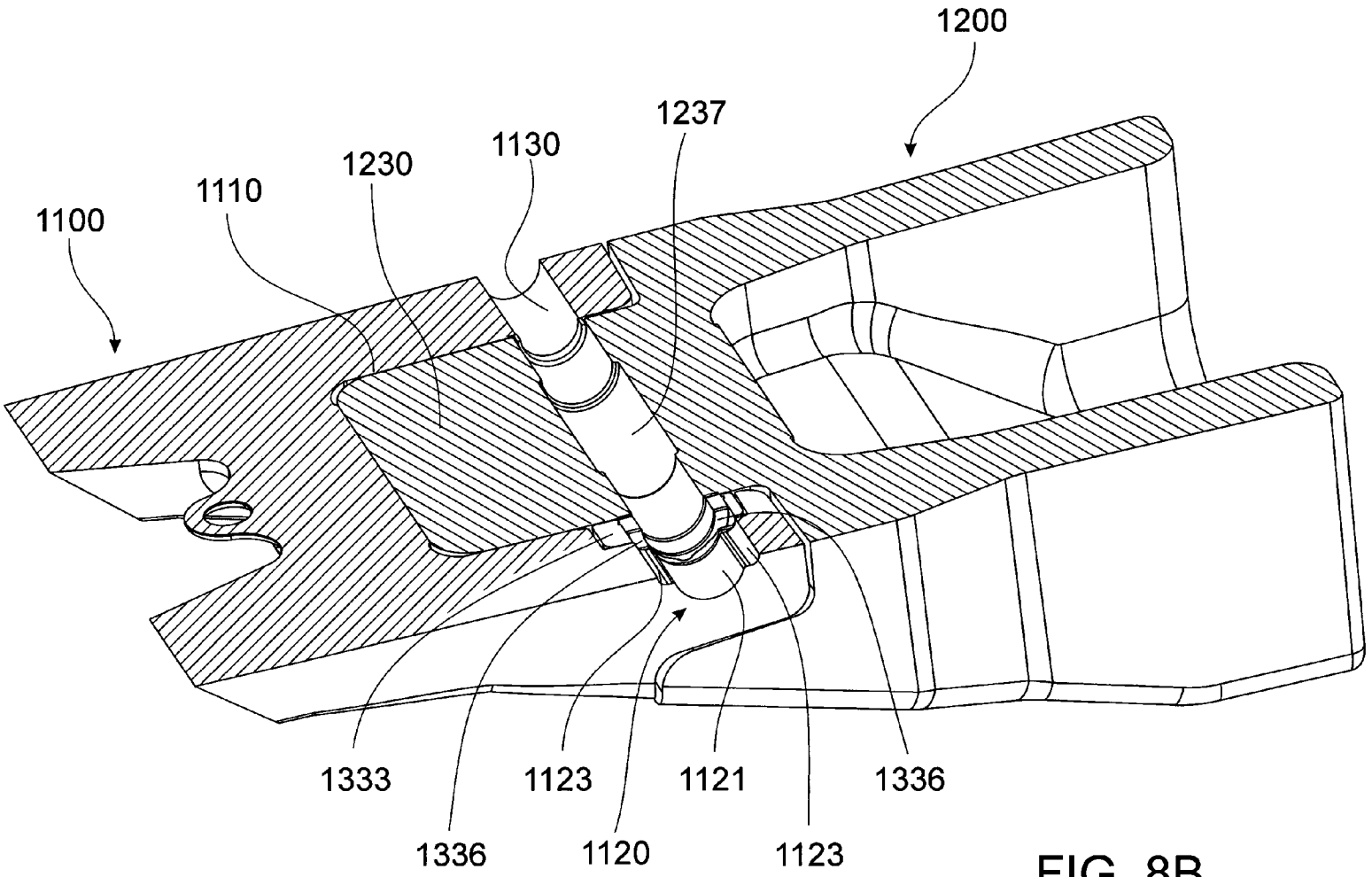
FIG. 8B shows a sectional top view of the tooth located on the adaptor.

The tooth 1100 is then slidably mounted onto adaptor 1200 such that spigot portion 1230 is located within socket cavity 1110 of tooth 1100 as previously discussed and as shown in FIG. 8A and FIG. 8B.

In this position, the retaining member 1330 is captively retained in retaining recess 1124 of tooth 1100 in view of retaining recess 1124 being coaxial with retaining passage 1237 of adaptor 1200. In this way, an outer face of washer 1301 and a lower face of annular wall 1333 of retaining member 1330 both contact an outer face of side wall 1236 of spigot portion 1230 to thereby captively retain retaining member 1330 in retaining recess 1124 a shown.

Figure 9A:
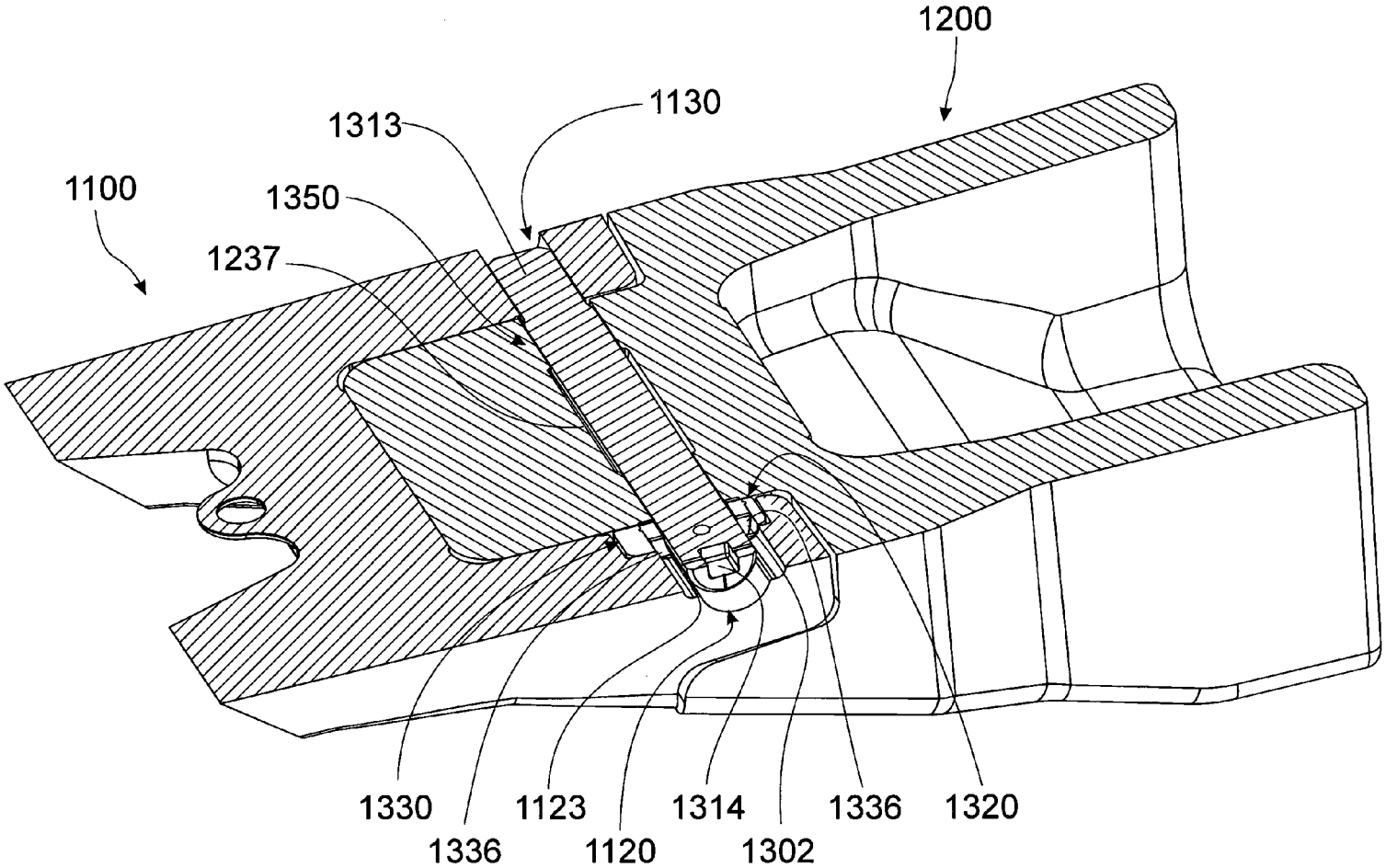
FIG. 9A shows locking pin forming part of the lock assembly located through aligned apertures in the tooth and passage in the adaptor, the locking pin positioned in the locked position.
Figure 9B:
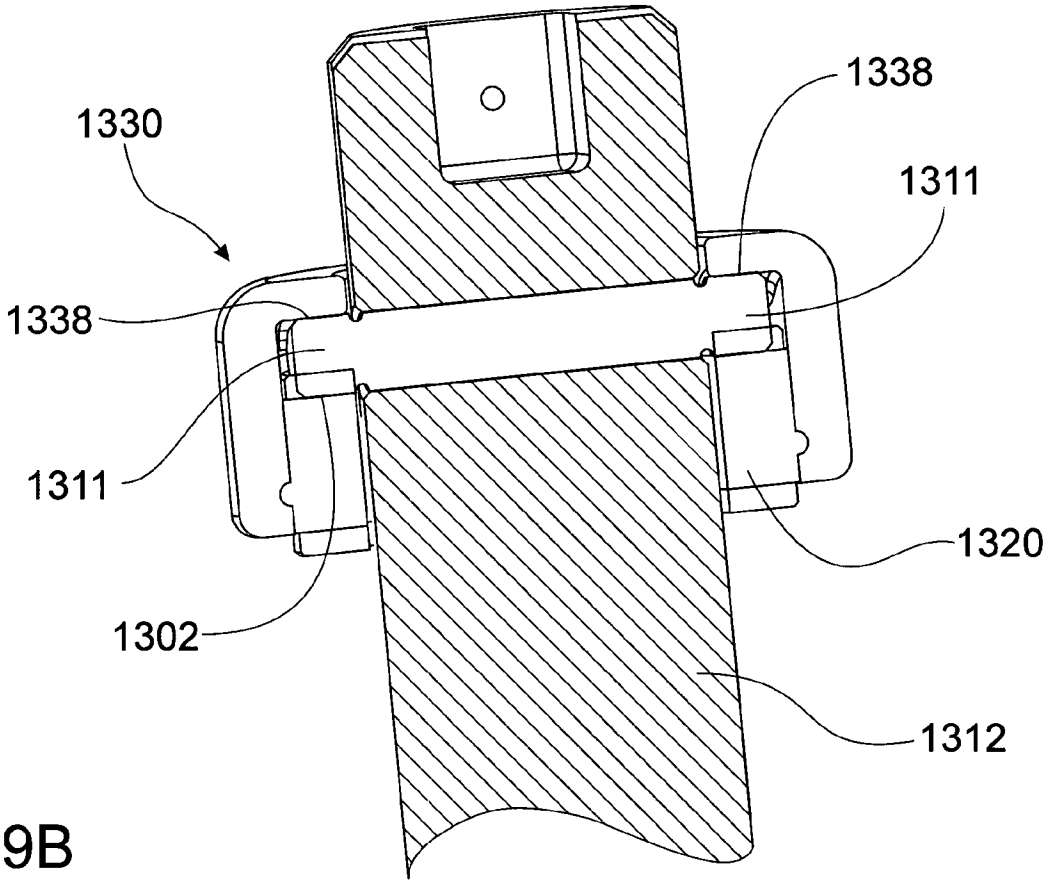
FIG. 9B shows a sectional view of the lock assembly in the locked position.

Retaining pin 1310 of lock assembly 1300 is then located through at least partially aligned locking aperture 1120, retaining passage 1237 and toe aperture 1120 as shown in FIG. 9A in order to place the lock assembly 1300 in the locked position to releasably retain tooth 1100 on adaptor 1200. FIG. 9B shows a section perspective view of locking assembly 1300 in the locked position with the adaptor 1200 and tooth 1100 removed from the view for clarity.

Toe portion 1313 of locking pin 1310 is first located through locking aperture 1120 of tooth 1100. Toe portion 1313 travels through receiving passage 1121 of locking aperture 1120, aligned aperture 1332A of retaining member and 1321 of biasing member 1320 and into retaining passage 1237 of spigot portion 1230 of adaptor 1200.

In this position, or prior to insertion, locking pin is rotated axially about a longitudinal axis thereof such that dowels 1311 are generally coplanar with a plane formed by aligned slots 1336 of retaining member 1330 and slots 1123 of receiving passage 1121 of tooth 1100.

In this orientation of locking pin 1310, dowels 1311 are received through respective aligned slots 1336 and 1123 as locking pin 1310 is further translated within retaining passage until a face of each dowel contacts 1311 contacts an outer face of washer 1302. At this stage of insertion, toe portion 1313 is located within toe aperture 1130 of tooth 1100 as shown.

In this position, lock assembly 1300 is in the insertion position. In order to move lock assembly to the locked position as shown in FIGS. 9A and 9B, locking pin 1310 is rotated axially about a longitudinal axis thereof in order to move each dowel 1311 away from a respective slot 1336 into a respective seat 1338 of retaining member 1300.

Each dowel 1311 has a diameter that is greater in length than a length between an outer face of washer 1302 and an inner surface of land 1339A. As such, as locking pin 1310 is axially rotated, a face of each dowel 1311 is urged into abutment with a face of a respective angled guide surface 1339 whilst an opposing face of each dowel 1311 remains in contact with an outer face of washer 1302.

As previously discussed, biasing member 1200 is formed from a resiliently deformable material such that as the locking pin 1310 is axially rotated and each dowel 1311 travels against a respective angled guide surface 1339, biasing member 1320 is thereby compressed.

When a face of each dowel 1311 bears against a face of a respective land 1339A, biasing member is at full compression. As the locking pin 1310 continues to be axially rotated, a face of each dowel 1311 is urged by the compressive force of biasing member 1320 into a respective seat 1338.

In this position, a face of each dowel 1311 is held in firm abutment with a face of seat 1338 by a biasing force supplied by biasing member 1320 in order to captively retain locking pin 1310 within partially aligned locking aperture 1120, retaining passage 1237 and toe aperture 1120 as shown.

Suitably, a power tool is used to axially rotate locking pin 1310 such that a sufficient force is used to overcome the biasing force of biasing member 1320. Furthermore, locking pin may be rotated in either axial direction in order to move lock assembly 1300 into the locked position from the insertion position.

In the locked position, compression washer 1350 extends about toe portion 1313 within retaining passage 1237 or adaptor 1200 adjacent toe aperture 1130 in order to prevent the ingress of fines and the like therein.

Figure 10A:
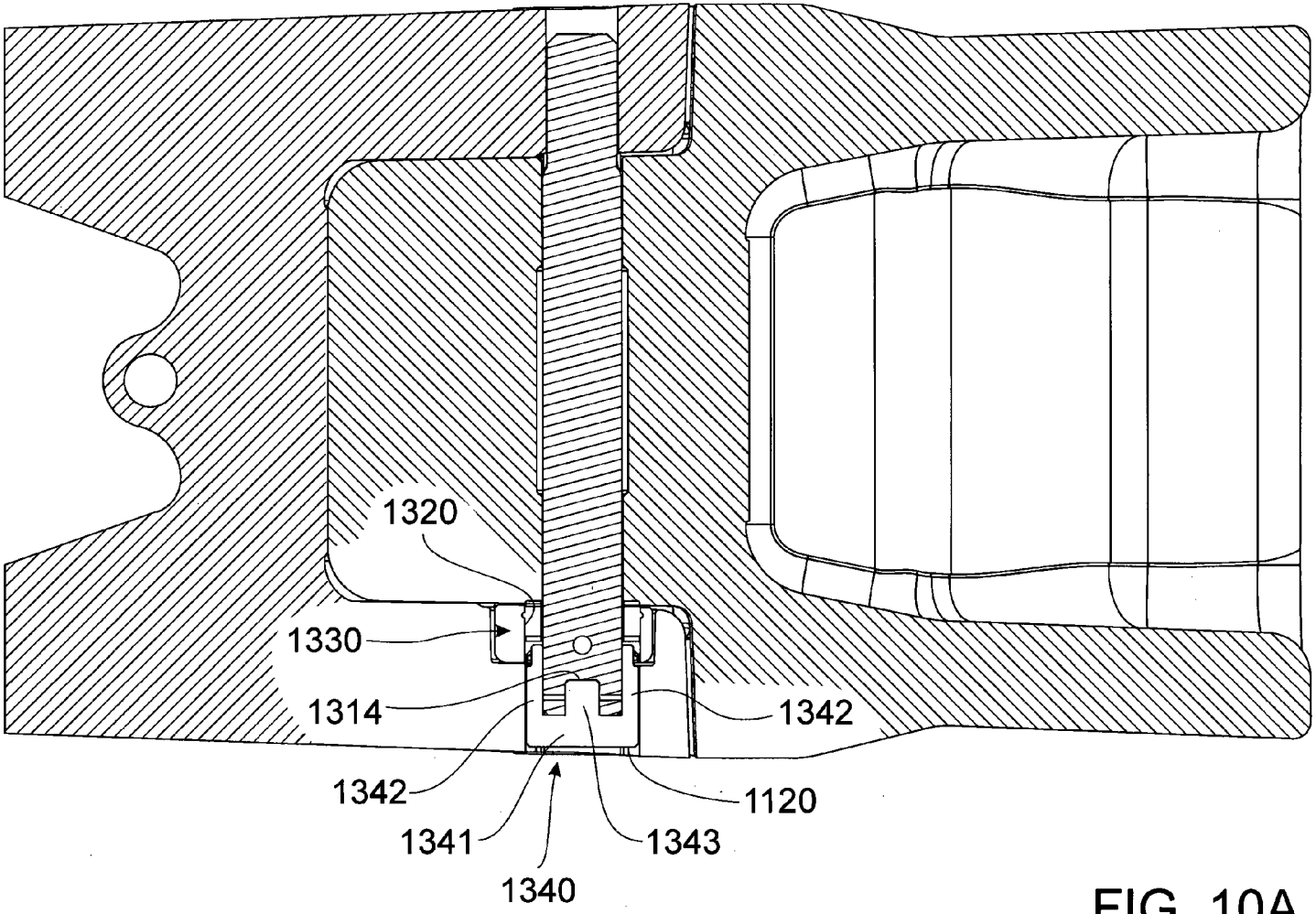
FIG. 10A shows a sectional top view of the lock assembling in the locked position with a keeper associated therewith.
Figure 10B:
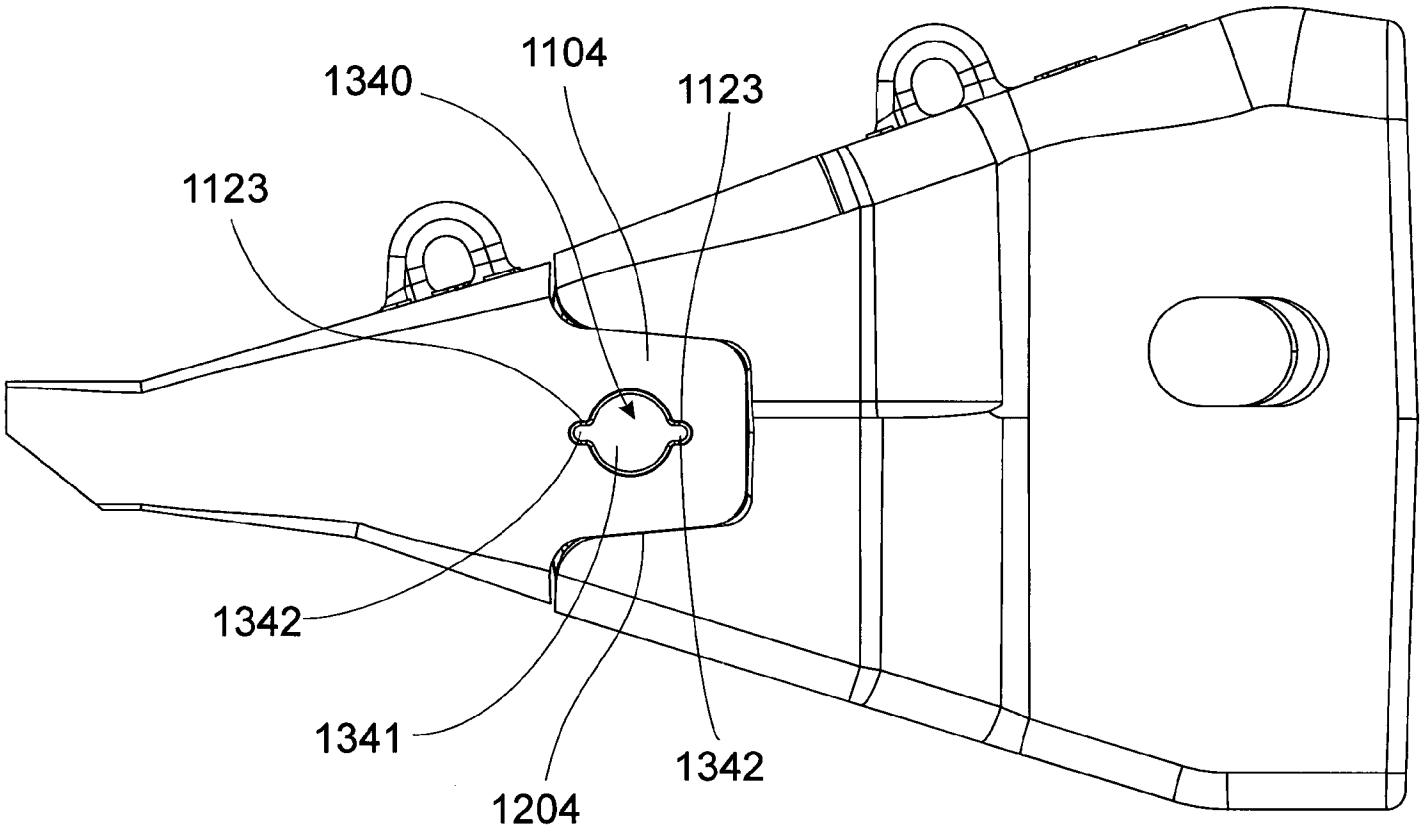
FIG. 10B shows a perspective view of the excavator wear assembly shown in FIG. 1A.

Keeper 1340 is then located within locking aperture 1120 as shown in FIG. 10A and FIG. 10B. Plug 1343 is located within recess 1314 by way of an interference fit in order that keeper 1340 is secured to locking pin 1310. Furthermore, legs 1342 extend through slots 1123 from an outer extent thereof and terminate within cavity 1334 of retaining member 1330.

In this way, the location of legs 1342 ensure that locking pin 1310 cannot rotate to a position such that dowels are in alignment with slots 1336 in the event that the locking pin 1310 is subjected to large rotational loads during use. Keeper 1340 also prevents ingress of fines and the like into locking aperture 1120.

In order to move lock assembly 1300 to the insertion position, the keeper 1340 is removed and the locking pin 1310 is suitably rotated in order that dowels 1311 align with respective aligned slots 1336 and 1123 in order that locking pin 1310 may be withdrawn to remove tooth 1100 from adaptor 1200.

In a further form, the invention resides in a novel tooth and adaptor.

Figure 11A:
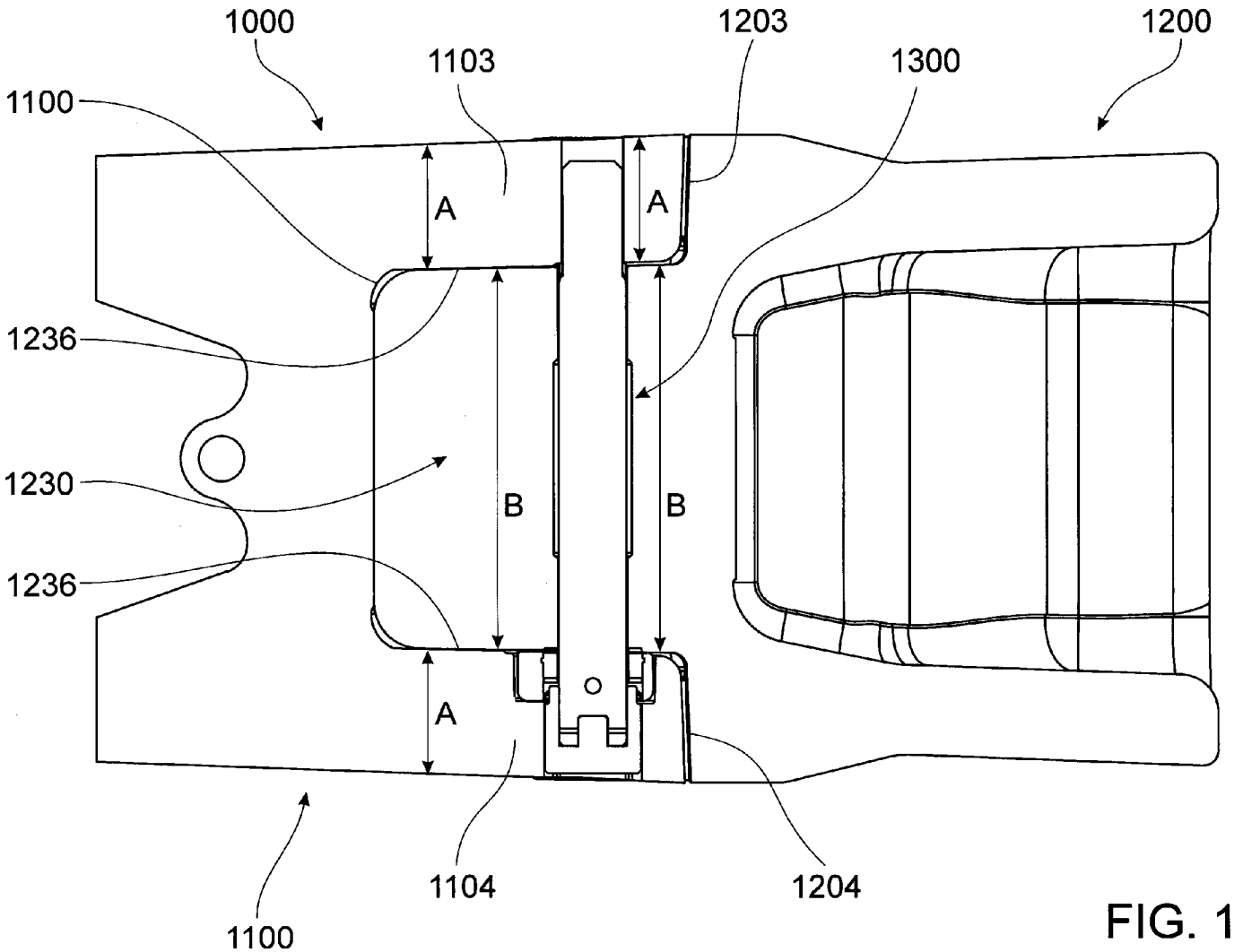
FIG. 11A shows a section top view of an excavator wear assembly according to a further aspect of the invention.
Figure 11B:
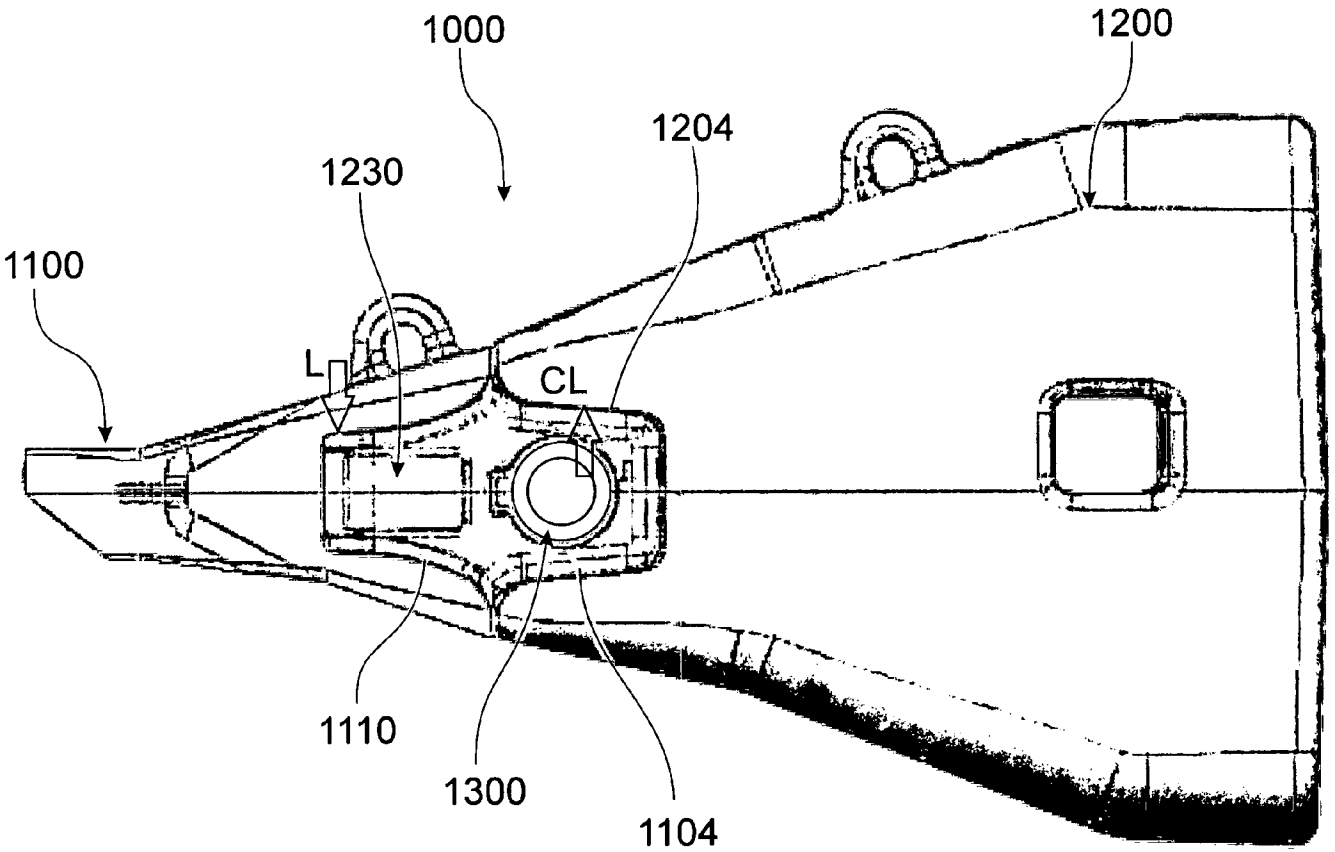
FIG. 11B shows a side view the excavator wear assembly shown in FIG. 11A with a wear member forming part of the excavator wear assembly shown in phantom.

FIG. 11A shows a section top view of an excavator wear assembly 1000 according to a further aspect of the invention FIG. 11B shows a side view the excavator wear assembly 1000 with a wear member in the form of tooth 1100 forming part of the excavator wear assembly 1000 shown in phantom.

The features of wear member in the form of tooth 1100 and adaptor 1200 are as previously discussed. However, each of tooth 1100 and adaptor 1200 have transverse dimensions that are particularly advantageous when the tooth 1100 is subjected to load when mounted upon the adaptor 1200 as discussed below.

As previously discussed, spigot portion 1230 of adaptor 1200 is adapted to be received within socket cavity 1110 of tooth 1100. In this position, mounting ears 1103 and 1104 are located within respective mounting recesses 1203 and 1204.

A pin 1300 is located through aligned apertures 1120 and 1130 in respective mounting ears 1103 and 1104 of tooth 1100 and retaining passage 1237 through spigot portion 1230 of adaptor 1200 to thereby releasably secure the tooth 1100 upon the adaptor 1200.

In use, an end extent of spigot 1230 is subject to point loads L as shown in FIG. 11B. Load L is transferred about the axis of the locking pin 1300 such that a face of each mounting ear 1103, 1104 transfers a force CL to a face of the respective mounting recesses 1203, 1204.

A load scenario of this nature places a large force on the mounting ears 1103,1104 giving rise to the possibility that the ears 1103,1104 may fail through cracking and the like. The possible consequence of having an mounting ear 1103, 1104 crack is that the tooth 1100 may prematurely detach from the adaptor 1200. There are undesirable health and safety issues associated with a tooth prematurely detaching from the adaptor during use.

The inventors have found that by having an adaptor 1200 that has a spigot 1230 having a transverse dimension, particularly a width B, that is relatively smaller than the width of prior art adaptor spigots and having a tooth 1100 having mounting ears 1103, 1104 that each have a transverse dimension, in particular a width A, that is relatively larger than the width of prior art mounting ears, premature tooth detachment as a result of failure in the mounting ears is mitigated.

By having a mounting ear 1103, 1104 that has a face having the width dimension A, a larger contact face is formed with a face of a respective mounting recess 1203, 1204 to bear the counter load CL and hence mitigate the risk of cracking in the mounting ear 1103,1104.

In particular, the inventors have found that having a ratio of transverse dimension A of each mounting ear 1103,1104 to transverse dimension B of the spigot portion 1230 in the range 0.25 to 0.4 to be particularly advantageous in mitigating failure in the mounting ears 1103, 1104.

In particular, the inventors have found that having a ratio of transverse dimension A of each mounting ear 1103,1104 to transverse dimension B of the spigot portion 1230 being 0.25, 0.26, 0.27, 0.28, 0.29, 0.30, 0.31, 0.32, 0.33, 0.34, 0.35, 0.36, 0.37, 0.38, 0.39 or 0.40 to be particularly advantageous in mitigating failure in the mounting ears 1103, 1104.

The inventors have found that a transverse dimension A of each mounting ear 1103,1104 being one third the transverse dimension B of the spigot portion 1230 as being most advantageous in mitigating failure in the mounting ears 1103, 1104.

As previously discussed, the spigot portion 1230 of the adaptor is adapted to be located within the socket cavity 1110 of the tooth 1100. As such, the transverse dimension A in the form of the width of each mounting ear 1103,1104 may similarly be expressed with reference to a transverse dimension, in the form of a width B, of the socket cavity 1110. Suitably, the width B of the socket cavity 1110 is the distance between an inner face of mounting ear 1103 and an inner face of mounting ear 1104.

As such, the ratio of transverse dimension A of each mounting ear 1103,1104 to transverse dimension B of the socket cavity 1110 being in the range 0.25 to 0.4 has been found to be particularly advantageous in mitigating failure in the mounting ears 1103, 1104.

A ratio of transverse dimension A of each mounting ear 1103,1104 to transverse dimension B of the socket cavity 1110 being 0.25, 0.26, 0.27, 0.28, 0.29, 0.30, 0.31, 0.32, 0.33, 0.34, 0.35, 0.36, 0.37, 0.38, 0.39 or 0.40 has been found to be particularly advantageous in mitigating failure in the mounting ears 1103, 1104.

The inventors have found that a transverse dimension A of each mounting ear 1103,1104 being one third the transverse dimension B of the Socket cavity 1110 as being most advantageous in mitigating failure in the mounting ears 1103, 1104.

By having a mounting ear that has a face having a transverse dimension, in the form of width A, defined as a ratio of a transverse dimension of either the spigot portion 1230 or the socket cavity 1110, in the form of width B, a larger contact face is formed to bear the counter load CL and hence mitigated the risk of cracking in the mounting ear.

The excavator wear assembly of the invention and the lock assembly for securing the wear member in the form of a tooth to an adaptor avoids the need for threaded components and complex parts. Furthermore, the lock assembly avoids the need for heavy hammers and the like for mounting within the respective, retaining apertures and retaining cavities. In this way, the invention provides for an effective method of releasably securing the tooth to the adaptor.

Throughout the specification the aim has been to describe the invention without limiting the invention to any one embodiment or specific collection of features. Persons skilled in the relevant art may realize variations from the specific embodiments that will nonetheless fall within the scope of the invention.

It will be appreciated that various other changes and modifications may be made to the embodiment described without departing from the spirit and scope of the invention.

In this specification, where different embodiments share identical features, common reference numbers are used to identify those identical features.

The invention claimed is:

1. An excavator wear assembly comprising:

an adaptor having a spigot portion, the spigot portion having a transverse dimension;

a wear member releasably mountable on the adaptor, the wear member having a body with a socket cavity, the socket cavity adapted to receive the spigot portion of the adaptor, the wear member further including a pair of mounting ears extending from the body, each of the mounting ears having a transverse dimension, each of the mounting ears also having a top face and a bottom face that are arranged such that both the top and the bottom faces are aligned to converge at different angles relative to a horizontal plane therebetween;

wherein, the transverse dimension of each mounting ear is in the range 0.25 to 0.4 of the transverse dimension of the spigot portion.

2. The excavator wear assembly of claim 1, wherein the transverse dimension of each mounting ear is in the range 0.26 to 0.39 of the transverse dimension of the spigot portion.

3. The excavator wear assembly of claim 1, wherein the transverse dimension of each mounting ear is in the range 0.27 to 0.38 of the transverse dimension of the spigot portion.

4. The excavator wear assembly of claim 1, wherein the transverse dimension of each mounting ear is in the range 0.28 to 0.37 of the transverse dimension of the spigot portion.

5. The excavator wear assembly of claim 1, wherein the transverse dimension of each mounting ear is in the range 0.29 to 0.36 of the transverse dimension of the spigot portion.

6. The excavator wear assembly of claim 1, wherein the transverse dimension of each mounting ear is in the range 0.3 to 0.35 of the transverse dimension of the spigot portion.

7. The excavator wear assembly of claim 1, wherein the transverse dimension of each mounting ear is in the range 0.31 to 0.34 of the transverse dimension of the spigot portion.

8. The excavator wear assembly of claim 1, wherein the transverse dimension of each mounting ear is 0.32 of the transverse dimension of the spigot portion.

9. The excavator wear assembly of claim 1, wherein the transverse dimension of each mounting ear is 0.33 of the transverse dimension of the spigot portion.

10. The excavator wear assembly of claim 1, wherein the transverse dimension of each mounting ear is one third of the transverse dimension of the spigot portion.

11. The excavator wear assembly of claim 1, wherein the transverse dimension of each mounting ear is a distance from an outer face of the respective mounting ear to an inner face thereof.

12. The excavator wear assembly of claim 11, wherein the inner face of each mounting ear is adapted to oppose and engage a respective sidewall of the spigot portion of the adaptor.

13. The excavator wear assembly of claim 1, wherein the transverse dimension of the spigot portion is a distance between opposed sidewalls thereof.

14. The excavator wear assembly of claim 1, wherein the wear member is a digging tooth.

15. The excavator wear assembly of claim 1, wherein the spigot portion of the adaptor is symmetrical about a horizontal plane of the adaptor.

16. The excavator wear assembly of claim 1, wherein the adaptor further comprises a pair of side wall mounting recesses located in a forward portion of respective opposed side walls of the adaptor, the side wall mounting recess being symmetrical about a horizontal plane of the adaptor.

17. The excavator wear assembly of claim 1, wherein the mounting ears of the wear member are symmetrical about a horizontal plane of the wear member.

18. A wear member for an excavator wear assembly, the wear member comprising:

a body with a socket cavity, the socket cavity having a transverse dimension;

a pair of mounting ears extending from the body, each of the mounting ears having a transverse dimension, each of the mounting ears also having a top face and a bottom face that are arranged such that both the top and the bottom faces are aligned to converge at different angles relative to a horizontal plane therebetween; and wherein, the transverse dimension of each mounting ear is in the range 0.25 to 0.4 of the transverse dimension of the socket cavity.

19. The wear member of claim 18, wherein the transverse dimension of each mounting ear is in the range 0.26 to 0.39 of the transverse dimension of the socket cavity.

20. The wear member of claim 18, wherein the transverse dimension of each mounting ear is in the range 0.27 to 0.38 of the transverse dimension of the socket cavity.

21. The wear member of claim 18, wherein the transverse dimension of each mounting ear is in the range 0.28 to 0.37 of the transverse dimension of the socket cavity.

22. The wear member of claim 18, wherein the transverse dimension of each mounting ear is in the range 0.29 to 0.36 of the transverse dimension of the socket cavity.

23. The wear member of claim 18, wherein the transverse dimension of each mounting ear is in the range 0.3 to 0.35 of the transverse dimension of the socket cavity.

24. The wear member of claim 18, wherein the transverse dimension of each mounting ear is in the range 0.31 to 0.34 of the transverse dimension of the socket cavity.

25. The wear member of claim 18, wherein the transverse dimension of each mounting ear is 0.32 of the transverse dimension of the socket cavity.

26. The wear member of claim 18, wherein the transverse dimension of each mounting ear is 0.33 of the transverse dimension of the socket cavity.

27. The wear member of claim 18, wherein the transverse dimension of each mounting ear is one third of the transverse dimension of the socket cavity.

28. The wear member of claim 18, wherein the transverse dimension of the socket cavity is a distance between an inner face of the first mounting ear of the pair of mounting ears and an inner face of the second mounting ear of the pair of mounting ears.

29. The wear member of claim 18, wherein the transverse dimension of each mounting ear is a distance from an outer face of the respective mounting ear to an inner face thereof.

30. The wear member of claim 18, wherein the mounting ears of the wear member are symmetrical about a horizontal plane of the wear member.

* * * * *